US006672959B2

(12) United States Patent
Moody et al.

(10) Patent No.: US 6,672,959 B2
(45) Date of Patent: Jan. 6, 2004

(54) BONUS FEATURE ON STARTING HANDS

(76) Inventors: Ernest W. Moody, 2116 Redbird Dr., Las Vegas, NV (US) 89134; Michael W. Wood, 11831 Wentling Ave., Suite #C, Baton Rouge, LA (US) 70816

( * ) Notice: Subject to any disclaimer, the term of this patent is extended or adjusted under 35 U.S.C. 154(b) by 49 days.

(21) Appl. No.: 10/140,855

(22) Filed: May 7, 2002

(65) Prior Publication Data

US 2003/0032469 A1 Feb. 13, 2003

Related U.S. Application Data

(63) Continuation-in-part of application No. 09/558,892, filed on Apr. 26, 2000, now Pat. No. 6,419,578, and a continuation-in-part of application No. 09/175,226, filed on Oct. 20, 1998, now Pat. No. 6,098,985, and a continuation-in-part of application No. 09/083,531, filed on May 22, 1998, now Pat. No. 6,007,066, and a continuation-in-part of application No. 08/900,965, filed on Jul. 25, 1997, now Pat. No. 5,823,873, and a continuation-in-part of application No. 08/755,174, filed on Nov. 25, 1996, now Pat. No. 5,732,950, and a continuation-in-part of application No. 08/495,952, filed on Jun. 28, 1995, now Pat. No. 5,531,448.

(60) Provisional application No. 60/019,879, filed on Jun. 17, 1996.

(51) Int. Cl.[7] ..... A63F 1/00; G07F 17/34

(52) U.S. Cl. ..... 463/13; 463/20; 273/292; 273/143 R; 273/138.2

(58) Field of Search ..... 273/292, 274, 273/309, 143 R, 138.1, 138.2; 463/13, 12, 20

(56) References Cited

U.S. PATENT DOCUMENTS

| | | | | |
|---|---|---|---|---|
| 4,861,041 A | | 8/1989 | Jones et al. | 273/292 |
| 5,042,818 A | | 8/1991 | Weingardt | 273/292 |
| 5,165,693 A | * | 11/1992 | Handlon, Sr. | 273/298 |
| 5,542,669 A | | 8/1996 | Charron et al. | 463/13 |
| 5,544,892 A | | 8/1996 | Breeding | 273/292 |
| 5,868,618 A | | 2/1999 | Netley et al. | 463/13 |
| 5,882,259 A | | 3/1999 | Holmes, Jr. et al. | 463/13 |
| 6,537,150 B1 | * | 3/2003 | Luciano et al. | 463/16 |

* cited by examiner

*Primary Examiner*—Benjamin H. Layno
(74) *Attorney, Agent, or Firm*—John Edward Roethel

(57) ABSTRACT

A starting hand of five cards is dealt and the player then plays this hand with a first pay table. If the player's starting hand of cards has a poker hand ranking of any preselected combination of cards, such as a Pair of Jacks, a Pair of Queens, a Pair of Kings or a Pair of Aces, the player is given the option of exchanging his starting hand for one or more different new partial hands, such as Three to a Royal Flush or multiple hands of a Pair of Aces. If the player accepts the offer to make the exchange, the different partial hand is displayed and then additional cards are dealt to complete a five card hand. If the final five card hand is one of the predetermined winning poker hand combinations, the player receives an award.

18 Claims, 16 Drawing Sheets

BONUS FEATURE ON STARTING HANDS

CROSS-REFERENCE TO RELATED APPLICATIONS

This application is a Continuation-in-Part of application Ser. No. 08/495,952, entitled "Poker-Style Card Game", filed Jun. 28, 1995, now U.S. Pat. No. 5,531,448; and is also based on and is a Continuation-in-Part of Provisional Application Ser. No. 60/019,879, entitled "Electronic Video Poker Games", filed Jun. 17, 1996; and is also a Continuation-in-Part of application Ser. No. 08/755,174, entitled "Electronic Video Poker Games", filed Nov. 25, 1996, now U.S. Pat. No. 5,732,950; and is also a Continuation-in-Part of application Ser. No. 08/900,965, entitled "Electronic Video Poker Games", filed Jul. 25, 1997, now U.S. Pat. No. 5,823,873; and is also a Continuation-in-Part of application Ser. No. 09/083,531, entitled "Electronic Video Poker Games", filed May 22, 1998, now U.S. Pat. No. 6,007,068; and is also a Continuation-in-Part of application Ser. No. 09/175,226, entitled "Electronic Video Poker Games", filed Oct. 20, 1998, now U.S. Pat. No. 6,098,985; and is also a Continuation-in-Part of application Ser. No. 09/558,892, entitled "Bonus Feature on Starting Hands", filed Apr. 26, 2000, now U.S. Pat. No. 6,419,578. The disclosure of each of these earlier applications is incorporated herein by this reference, with each of these earlier applications being commonly owned with this application.

BACKGROUND OF THE INVENTION

This invention relates primarily to electronic video poker games, and more particularly to electronic video poker games that are single player games in which a player plays one or more poker hands against a pay table, and not against a dealer's hand. The player attempts to achieve final card combinations that are based on poker hand rankings. Typically an initial hand is dealt to the player and the player is allowed to discard unwanted cards and to replace the unwanted cards with replacement cards. The final poker hand is compared to a pay table to determine winning and losing hands. During the play of the game, the player may achieve special bonus hand combinations that allow the player the chance to achieve higher payouts.

The present invention has many variations with the common thread being that bonus payouts are available to the player when the player's initial hand has a one or more of a certain preselected combination of cards. In one variation, the player is provided a special pay table with higher payouts whenever the player is dealt a starting hand of a certain preselected combination of cards, such as Three-of-a-Kind. In another variation, the player is provided an additional poker hand to play whenever the player is dealt a starting hand of a certain preselected combination of cards, such as Three-of-a-Kind. In still another variation, the player is taken to a bonus round whenever the player's initial poker hand is a certain preselected combination of cards, such as a Straight or Better. In yet another variation, whenever the player receives a predetermined starting hand, the player is offered the opportunity to exchange his starting hand for one or more different starting hands.

SUMMARY OF THE INVENTION

The method of present invention involves dealing the player a starting hand of cards, such as five cards, and the player then plays this hand with a first pay table. If the player's starting hand of cards has a poker hand ranking of any preselected combination of cards, such as a Three-of-a-Kind, the player is given the option of choosing to play the rest of the hand with a second pay table which has higher awards to the player than the first pay table. The player may be required to risk an additional wager, or the player may be required to give up some of his winning award, in order to receive the second pay table. If the player accepts the offer of the second pay table, the player plays out his hand against the second pay table. If the player declines the offer of the second pay table, the player plays out his hand against the first pay table. This method of play may be played in either a single hand format or in a multiple hand format.

In another variation of the present invention, the method of play involves dealing the player a starting hand of cards, such as five cards, and the player would play this hand with a pay table. If the player's starting hand of cards has a poker hand ranking of a preselected combination of cards, such as a Three-of-a-Kind, the player is given a second hand of cards identical to the first hand of cards. The player then plays out both the first hand and the second hand by discarding and drawing replacement cards. The final first hand and the final second hand are then compared to the pay table to determine winning and losing combinations based on poker hand ranking. This method of play may also be played in a multiple hand format.

Still another variation of the method of play of the present invention involves awarding the player with a bonus round of play if the player's initial dealt hand is a preselected poker hand combination, such as a Straight or Better. This bonus round of play may have many variations. For example, the bonus round may be providing the player with a free multiple hand game, such as a Triple Play hand. The player plays out his Triple Play hand according to the conventional manner of play of Triple Play and any awards received by the player are in addition to any payouts the player receives for the play of his initial hand.

In yet another variation of the method of play of the present invention, if the player's initial dealt hand is a preselected poker hand combination, such as a Pair of Jacks, a Pair of Queens, or a Pair of Kings, the player is offered the opportunity to exchange his starting hand for one or more different starting hands, such as Three to a Royal Flush. If the player accepts the offer, the player is dealt three of the five cards needed to complete a Royal Flush. Then the two remaining cards are dealt and the player receives an award if the final five card hand has one of the predetermined winning poker hand rankings shown in a pay table.

In still another variation of the method of play of the present invention, if the player's initial dealt hand is a preselected poker hand combination, such as a Pair of Aces, the player is offered the opportunity to exchange his starting hand for two or more different starting hands, such as a Pair of Aces. If the player accepts the offer, the player is dealt the Pair of Aces in each of two or more hands. Then the three remaining cards are dealt and the player receives an award if the final five card hand has one of the predetermined winning poker hand rankings shown in a pay table.

DETAILED DESCRIPTION OF THE PREFERRED EMBODIMENTS

The present invention includes a variety of electronic video poker games. Each electronic video poker game is designed to be played by having one or more poker hands displayed on a video screen to a player. These are "player's hand only" poker games in which the player does not play against a dealer's hand or against other players, but merely attempts to achieve a winning poker hand combination using the player's final cards of the hand.

An initial deal of cards comprises the player's initial hand. By manipulating the buttons on the gaming device or by using conventional touch screen technology, the player selects which cards he wishes to hold in his hand and thus which cards he wishes to discard. Replacement cards are then displayed for the discarded cards and the outcome of the play of the hand is determined. The resulting poker hand ranking of the final hand is then compared to a pay table to determine whether the player has a winning hand combination. A player is paid an award based on the poker hand ranking of the final hand and the number of coins, tokens or credits wagered by the player as shown in the pay table.

Figure 1:
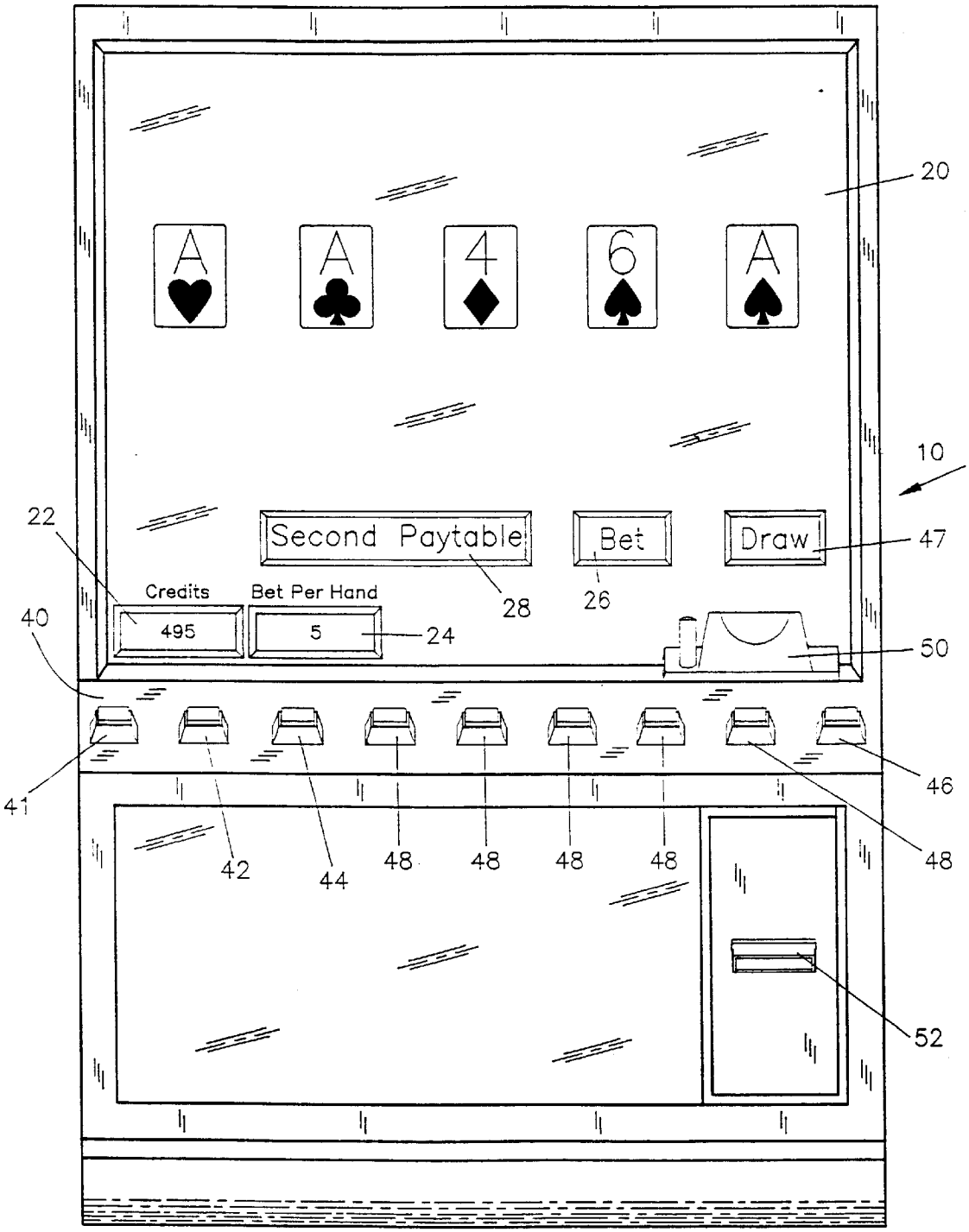
FIG. 1 shows the screen display for Version #1 of the present invention after the initial deal of the cards.

FIG. 1 shows a gaming machine upon which the method of the present invention can be carried out. The gaming machine 10 includes a video screen display 20 on which are shown the playing cards that will be used during the play of the method of the present invention. The video screen display 20 also includes other information and data presented to the player to allow the player to understand the play of the game and to effect the operation of the method.

In the preferred embodiment of the present invention, the video screen display shows a credit meter 22 and a display 24 of the number of credits bet per hand. The video screen display also has touch screen locations to allow the player to DRAW 47 replacement cards, to make his initial BET 26 and to choose a SECOND PAY TABLE 28. Each of the card locations on the video screen display can also be touch screen locations so that the player may designate which cards he wishes to hold by merely touching the card location on the video screen display 20.

The gaming machine 10 also has a button panel 40 which includes typical buttons that the player may press to activate various actions during the play of the method of the present invention. A CASH OUT button 41 is provided to allow the player to collect any credits which the player has accrued on the credit meter 22. A BET MAX button 42 and a BET ONE button 44 are provided to allow the player to wager either the maximum amount of credits permitted by the gaming machine or to wager one credit at a time on the play of the game as desired by the player. A DRAW button 46 is provided to allow the player to effect the draw step of the method of play as desired should the player prefer to use the button panel instead of the DRAW touch screen location 47 on the video screen display 20. A plurality of HOLD buttons 48 are also provided to allow the player to select which cards the player wishes to hold should the player prefer to use the button panel instead of the card touch screen locations on the video screen display 20.

The gaming machine 10 also includes a coin head 50 to allow the player to insert coins or gaming tokens as wagers to allow play of the gaming machine 10. A bill acceptor slot 52 is also provided on the gaming machine 10. In order to accrue credits that may be used to play the gaming machine 10, the player inserts paper currency or other suitable script or gaming coupons into the bill acceptor slot 52 behind which, on the interior of the gaming machine 10, is mounted a bill acceptor which takes in and validates the currency. The monetary value of the inserted currency is then applied to the credit meter 22, the credits on which the player may use to play the gaming machine.

Any other conventional and suitable equipment can be included in the gaming machine.

The method of play of electronic video poker may be modified in accordance with the present invention by adding various bonus features.

Version #1.

Bonus Feature on Dealt Three-of-a-Kind

This bonus feature is applied to a five card draw poker game. In a typical five card draw poker game, the player is initially dealt five cards all face up. The player then selects none, one or more of the initial five cards as cards to be held. The unselected cards are discarded and replacement cards for the discarded cards are dealt to the player. The poker hand ranking of the final five card hand determines whether the player has a winning or losing hand. A pay table, such as the one shown in Table 1, shows the winning poker hand combinations and the amount that the player wins for winning hand combinations is based on the amount of the player's wager.

The bonus feature of this Version #1 occurs whenever the player is dealt a Three-of-a-Kind on the initial deal of five cards. The player is presented with a second pay table, such as the pay table shown in Tables 2–10, that is different from the first pay table and offers higher payouts to the player for poker hand card combinations that can be achieved when the player's starting hand is Three-of-a-Kind. The player is given the option of selecting the second pay table as the pay table to be used when the player holds the Three-of-a-Kind and continues with the draw and replacement card steps of the method of play.

Table 1 shows a representative pay table that can be the first pay table that is provided to the player during the normal play of the video poker game.

TABLE 1

| POKER HAND | NUMBER OF COINS BET 1 | 2 | 3 | 4 | 5 |
|---|---|---|---|---|---|
| ROYAL FLUSH | 250 | 500 | 750 | 1000 | 4000 |
| STRAIGHT FLUSH | 50 | 100 | 150 | 200 | 250 |
| FOUR ACES WITH A KICKER (2, 3 OR 4) | 400 | 800 | 1200 | 1600 | 2000 |
| FOUR 2'S, 3'S OR 4'S WITH A KICKER (ACE, 2, 3 OR 4) | 160 | 320 | 480 | 640 | 800 |
| FOUR ACES | 160 | 320 | 480 | 640 | 800 |
| FOUR 2's, 3's OR 4's | 80 | 160 | 240 | 320 | 400 |
| FOUR 5's THRU KINGS | 50 | 100 | 150 | 200 | 250 |
| FULL HOUSE | 8 | 16 | 24 | 32 | 40 |
| FLUSH | 5 | 10 | 15 | 20 | 25 |
| STRAIGHT | 4 | 8 | 12 | 16 | 20 |
| THREE-OF-A-KIND | 3 | 6 | 9 | 12 | 15 |
| TWO PAIR | 1 | 2 | 3 | 4 | 5 |
| JACKS OR BETTER | 1 | 2 | 3 | 4 | 5 |

The example shown in Table 1 is for a pay table that can be used with a Double Double Bonus Poker format for a video draw poker game. This pay table offers the player an expected return of approximately 95%. Alternatively, other payout tables can be utilized as the first pay table depending on the expected return the house wishes to offer to the player. The method of Version #1 of the present invention can be applied to any other suitable video poker formats such as Draw Poker, Bonus Poker, Double Bonus Poker, Triple Bonus Poker, Super Double Bonus Poker, Joker Poker, Deuces Wild Poker and the like.

Table 2 shows a representative pay table that can be the second pay table that is provided to the player whenever the player is dealt a Three-of-a-Kind during the play of the video poker game. Higher payouts are provided for the various Four-of-a-Kinds that can be achieved when the player holds the initial Three-of-a-Kind. In a preferred embodiment of the present invention, the player must hold the initial Three-of-a-Kind in order to be eligible to select the second pay table.

TABLE 2

| POKER HAND | NUMBER OF COINS BET 1 | 2 | 3 | 4 | 5 |
|---|---|---|---|---|---|
| ROYAL FLUSH | 250 | 500 | 750 | 1000 | 4000 |
| STRAIGHT FLUSH | 50 | 100 | 150 | 200 | 250 |
| FOUR ACES WITH A KICKER (2, 3 OR 4) | 800 | 1600 | 2400 | 3200 | 4000 |
| FOUR 2'S, 3'S OR 4'S WITH A KICKER (ACE, 2, 3 OR 4) | 250 | 500 | 750 | 1000 | 1250 |
| FOUR ACES | 200 | 400 | 600 | 800 | 1000 |
| FOUR 2's, 3's OR 4's | 100 | 200 | 300 | 400 | 500 |
| FOUR 5's THRU KINGS | 60 | 120 | 180 | 240 | 300 |
| FULL HOUSE | 6 | 12 | 18 | 24 | 30 |
| FLUSH | 5 | 10 | 15 | 20 | 25 |
| STRAIGHT | 4 | 8 | 12 | 16 | 20 |
| THREE-OF-A-KIND | 3 | 6 | 9 | 12 | 15 |
| TWO PAIR | 1 | 2 | 3 | 4 | 5 |
| JACKS OR BETTER | 1 | 2 | 3 | 4 | 5 |

This pay table offers the player an expected return of approximately 98.89%.

Figure 2:
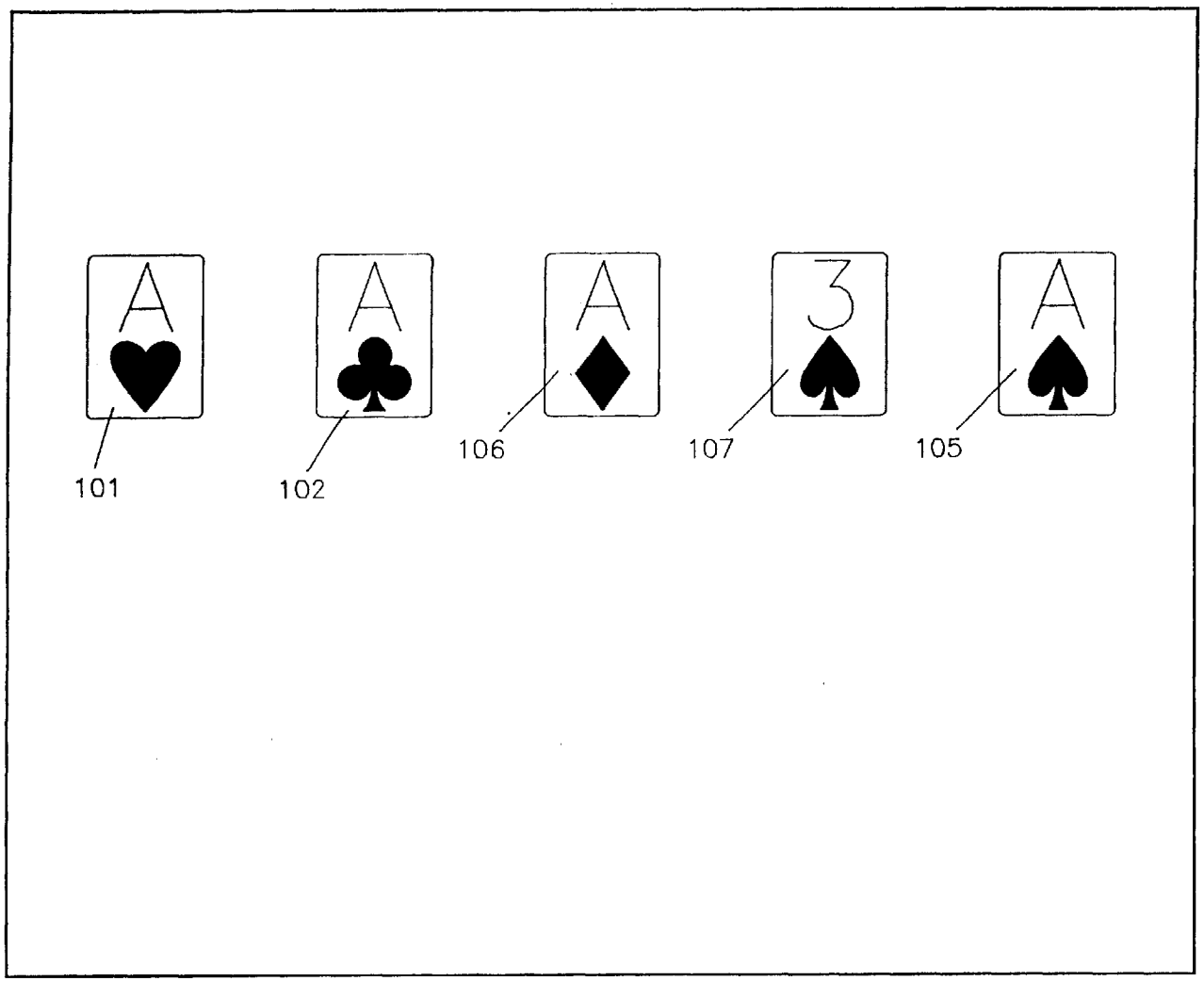
FIG. 2 shows the screen display for Version #1 after the draw step and shows a result that could occur during the play of the game.

FIGS. 1 and 2 show an example of the method of play of Version #1 of the present invention. In this example, the player has wagered five credits and the initial of deal of five cards to the player results in the player receiving the Ace of Hearts 101, the Ace of Clubs 102, the Four of Diamonds 103, the Six of Spades 104 and the Ace of Spades 105. Since the player has received a Three-of-a-Kind on the initial deal, the player is offered the opportunity play against the second pay table. In this example, the player accepts this offer by pressing the SECOND PAY TABLE 28 location.

The player the holds the Ace of Hearts 101, Ace of Clubs 102 and the Ace of Spades 105 and receives two replacement cards as shown in FIG. 2. The two replacement cards are the Ace of Diamonds 106 and the Three of Spades 107. Thus, the player's final five card hand has a poker hand ranking of Four-of-a-Kind with a kicker (the Three). For a five credit wager, the player would win four thousand credits as shown in Table 2.

If the payout for a Full House is increased to seven credits per coin wagered, an even better second pay table can be offered to the player. This pay table is shown in Table 3.

TABLE 3

| POKER HAND | NUMBER OF COINS BET 1 | 2 | 3 | 4 | 5 |
|---|---|---|---|---|---|
| ROYAL FLUSH | 250 | 500 | 750 | 1000 | 4000 |
| STRAIGHT FLUSH | 50 | 100 | 150 | 200 | 250 |
| FOUR ACES WITH A KICKER (2, 3 OR 4) | 800 | 1600 | 2400 | 3200 | 4000 |
| FOUR 2'S, 3'S OR 4'S WITH A KICKER (ACE, 2, 3 OR 4) | 250 | 500 | 750 | 1000 | 1250 |
| FOUR ACES | 200 | 400 | 600 | 800 | 1000 |
| FOUR 2's, 3's OR 4's | 100 | 200 | 300 | 400 | 500 |
| FOUR 5's THRU KINGS | 60 | 120 | 180 | 240 | 300 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 3 | 6 | 9 | 12 | 15 |
| TWO PAIR | 1 | 2 | 3 | 4 | 5 |
| JACKS OR BETTER | 1 | 2 | 3 | 4 | 5 |

This pay table offers the player an expected return of approximately 99.02%.

If the payout for a Full House is increased to eight credits per coin wagered, a yet even better second pay table can be offered to the player. This pay table is shown in Table 4.

TABLE 4

| POKER HAND | NUMBER OF COINS BET 1 | 2 | 3 | 4 | 5 |
|---|---|---|---|---|---|
| ROYAL FLUSH | 250 | 500 | 750 | 1000 | 4000 |
| STRAIGHT FLUSH | 50 | 100 | 150 | 200 | 250 |
| FOUR ACES WITH A KICKER (2, 3 OR 4) | 800 | 1600 | 2400 | 3200 | 4000 |
| FOUR 2'S, 3'S OR 4'S WITH A KICKER (ACE, 2, 3 OR 4) | 250 | 500 | 750 | 1000 | 1250 |
| FOUR ACES | 200 | 400 | 600 | 800 | 1000 |
| FOUR 2's, 3's OR 4's | 100 | 200 | 300 | 400 | 500 |
| FOUR 5's THRU KINGS | 60 | 120 | 180 | 240 | 300 |
| FULL HOUSE | 8 | 16 | 24 | 32 | 40 |
| FLUSH | 5 | 10 | 15 | 20 | 25 |
| STRAIGHT | 4 | 8 | 12 | 16 | 20 |
| THREE-OF-A-KIND | 3 | 6 | 9 | 12 | 15 |
| TWO PAIR | 1 | 2 | 3 | 4 | 5 |
| JACKS OR BETTER | 1 | 2 | 3 | 4 | 5 |

This pay table offers the player an expected return of approximately 99.15%.

In each of Tables 2, 3 and 4, the payout for Three-of-a-Kind is kept at three credits for each coin wagered. The player does not give up any of the payout for Three-of-a-Kind that the player would have received in the first pay table by selecting to play the second pay table when the player is initially dealt a Three-of-a-Kind.

If the payout for a Three-of-a-Kind is decreased to two credits for a Three-of-a-Kind in the initial hand, different second pay tables can be offered to the player as the bonus feature of the method of play. These pay tables require the player to make a choice between staying with the first pay table that provides the player three credits for each coin wagered for the Three-of-a-Kind or giving back some of the player's win in order to have the chance to win an even higher payout if the player improves the Three-of-a-Kind to a Four-of-a-Kind or a Full House.

Table 5 shows a representative second pay table with Three-of-a-Kind having a payout of two credits for each coin wagered, but with higher payouts for Four-of-a-Kinds and a Full House.

TABLE 5

| | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR ACES WITH A KICKER (2, 3 OR 4) | 800 | 1600 | 2400 | 3200 | 4000 |
| FOUR 2'S, 3'S OR 4'S WITH A KICKER (ACE, 2, 3 OR 4) | 250 | 500 | 750 | 1000 | 1250 |
| FOUR ACES | 200 | 400 | 600 | 800 | 1000 |
| FOUR 2's, 3's OR 4's | 120 | 240 | 360 | 480 | 600 |
| FOUR 5's THRU KINGS | 75 | 150 | 225 | 300 | 425 |
| FULL HOUSE | 10 | 20 | 30 | 40 | 50 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5 |

This pay table offers the player an expected return of approximately 98.76%.

Table 6 shows another representative second pay table with Three-of-a-Kind having a payout of two credits for each coin wagered, but with a slightly higher payouts for Four-of-a-Kind (Fives through Kings) and a lesser payout for a Full House.

TABLE 6

| | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR ACES WITH A KICKER (2, 3 OR 4) | 800 | 1600 | 2400 | 3200 | 4000 |
| FOUR 2'S, 3'S OR 4'S WITH A KICKER (ACE, 2, 3 OR 4) | 250 | 500 | 750 | 1000 | 1250 |
| FOUR ACES | 200 | 400 | 600 | 800 | 1000 |
| FOUR 2's, 3's OR 4's | 120 | 240 | 360 | 480 | 600 |
| FOUR 5's THRU KINGS | 80 | 160 | 340 | 320 | 400 |
| FULL HOUSE | 8 | 16 | 24 | 32 | 40 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5 |

This pay table offers the player an expected return of approximately 98.81%.

Table 7 shows another representative second pay table with Three-of-a-Kind having a payout of two credits for each coin wagered, but with a slightly higher payouts for Four-of-a-Kind (Four 2's, 3's and 4's with a kicker).

TABLE 7

| | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR ACES WITH A KICKER (2, 3 OR 4) | 800 | 1600 | 2400 | 3200 | 4000 |
| FOUR 2'S, 3'S OR 4'S WITH A KICKER (ACE, 2, 3 OR 4) | 300 | 600 | 900 | 1200 | 1500 |
| FOUR ACES | 200 | 400 | 600 | 800 | 1000 |
| FOUR 2's, 3's OR 4's | 120 | 240 | 360 | 480 | 600 |
| FOUR 5's THRU KINGS | 80 | 160 | 340 | 320 | 400 |
| FULL HOUSE | 8 | 16 | 24 | 32 | 40 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5 |

This pay table offers the player an expected return of approximately 98.01%.

If the payout for a Three-of-a-Kind is decreased to one credit for a Three-of-a-Kind in the initial hand, another set of different second pay tables can be offered to the player as the bonus feature of the method of play. These pay tables also require the player to make a choice between staying with the first pay table that provides the player three credits for each coin wagered for the Three-of-a-Kind or giving back most of the player's win in order to have the chance to win an even higher payout if the player improves the Three-of-a-Kind to a Four-of-a-Kind or a Full House.

Table 8 shows a representative second pay table with Three-of-a-Kind having a payout of one credit for each coin wagered, but with higher payouts for Four-of-a-Kinds and a Full House.

TABLE 8

| | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR ACES WITH A KICKER (2, 3 OR 4) | 800 | 1600 | 2400 | 3200 | 4000 |
| FOUR 2'S, 3'S OR 4'S WITH A KICKER (ACE, 2, 3 OR 4) | 300 | 600 | 900 | 1200 | 1500 |
| FOUR ACES | 200 | 400 | 600 | 800 | 1000 |
| FOUR 2's, 3's OR 4's | 120 | 240 | 360 | 480 | 600 |
| FOUR 5's THRU KINGS | 100 | 200 | 300 | 400 | 500 |
| FULL HOUSE | 8 | 16 | 24 | 32 | 40 |
| FLUSH | 5 | 10 | 15 | 20 | 25 |
| STRAIGHT | 4 | 8 | 12 | 16 | 20 |
| THREE-OF-A-KIND | 1 | 2 | 3 | 4 | 5 |
| TWO PAIR | 1 | 2 | 3 | 4 | 5 |
| JACKS OR BETTER | 1 | 2 | 3 | 4 | 5 |

This pay table offers the player an expected return of approximately 98.36%.

Table 9 shows another representative second pay table with Three-of-a-Kind having a payout of two credits for each coin wagered, but with a slightly higher payouts for certain Four-of-a-Kinds.

TABLE 9

| POKER HAND | NUMBER OF COINS BET 1 | 2 | 3 | 4 | 5 |
|---|---|---|---|---|---|
| ROYAL FLUSH | 250 | 500 | 750 | 1000 | 4000 |
| STRAIGHT FLUSH | 50 | 100 | 150 | 200 | 250 |
| FOUR ACES WITH A KICKER (2, 3 OR 4) | 800 | 1600 | 2400 | 3200 | 4000 |
| FOUR 2'S, 3'S OR 4'S WITH A KICKER (ACE, 2, 3 OR 4) | 300 | 600 | 900 | 1200 | 1500 |
| FOUR ACES | 250 | 500 | 750 | 1000 | 1250 |
| FOUR 2's, 3's OR 4's | 125 | 250 | 375 | 500 | 625 |
| FOUR 5's THRU KINGS | 100 | 200 | 300 | 400 | 500 |
| FULL HOUSE | 8 | 16 | 24 | 32 | 40 |
| FLUSH | 5 | 10 | 15 | 20 | 25 |
| STRAIGHT | 4 | 8 | 12 | 16 | 20 |
| THREE-OF-A-KIND | 1 | 2 | 3 | 4 | 5 |
| TWO PAIR | 1 | 2 | 3 | 4 | 5 |
| JACKS OR BETTER | 1 | 2 | 3 | 4 | 5 |

This pay table offers the player an expected return of approximately 98.70%.

Table 10 shows another representative second pay table with Three-of-a-Kind having a payout of two credits for each coin wagered, but with a slightly higher payouts for a certain Four-of-a-Kind (Four 2's, 3's and 4's with a kicker).

TABLE 10

| POKER HAND | NUMBER OF COINS BET 1 | 2 | 3 | 4 | 5 |
|---|---|---|---|---|---|
| ROYAL FLUSH | 250 | 500 | 750 | 1000 | 4000 |
| STRAIGHT FLUSH | 50 | 100 | 150 | 200 | 250 |
| FOUR ACES WITH A KICKER (2, 3 OR 4) | 800 | 1600 | 2400 | 3200 | 4000 |
| FOUR 2'S, 3'S OR 4'S WITH A KICKER (ACE, 2, 3 OR 4) | 320 | 640 | 960 | 1280 | 1600 |
| FOUR ACES | 250 | 500 | 750 | 1000 | 1250 |
| FOUR 2's, 3's OR 4's | 125 | 250 | 375 | 500 | 625 |
| FOUR 5's THRU KINGS | 100 | 200 | 300 | 400 | 500 |
| FULL HOUSE | 8 | 16 | 24 | 32 | 40 |
| FLUSH | 5 | 10 | 15 | 20 | 25 |
| STRAIGHT | 4 | 8 | 12 | 16 | 20 |
| THREE-OF-A-KIND | 1 | 2 | 3 | 4 | 5 |
| TWO PAIR | 1 | 2 | 3 | 4 | 5 |
| JACKS OR BETTER | 1 | 2 | 3 | 4 | 5 |

This pay table offers the player an expected return of approximately 98.80%.

Alternatively, other payout tables can be utilized depending on the expected return the house wishes to offer to the player.

As mentioned above, this bonus feature on dealt Three-of-a-Kinds can also be applied to other poker game formats. For example, one of the poker game formats could be Super Double Bonus Poker in which increased payouts are offered for various Four-of-a-Kinds, such as Four 2's, 3's or 4's; Four Kings, Queens or Jacks; and Four Aces.

A typical Super Double Bonus Poker pay table is shown in Table 11 and would be the first pay table provided to the player.

TABLE 11

| POKER HAND | NUMBER OF COINS BET 1 | 2 | 3 | 4 | 5 |
|---|---|---|---|---|---|
| ROYAL FLUSH | 250 | 500 | 750 | 1000 | 4000 |
| STRAIGHT FLUSH | 80 | 160 | 240 | 320 | 400 |
| FOUR ACES | 160 | 320 | 480 | 640 | 800 |
| FOUR KINGS, QUEENS OR JACKS | 120 | 240 | 360 | 480 | 600 |
| FOUR 2's, 3's OR 4's | 80 | 160 | 240 | 320 | 400 |
| FOUR 5's THRU TENS | 50 | 100 | 150 | 200 | 250 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 3 | 6 | 9 | 12 | 15 |
| TWO PAIR | 1 | 2 | 3 | 4 | 5 |
| JACKS OR BETTER | 1 | 2 | 3 | 4 | 5 |

Whenever the player is dealt a Three-of-a-Kind on his initial hand, the player is then offered a second pay table with increased payouts whenever the player improves his hand, i.e. achieves a Full House or a Four-of-a-Kind. Table 12 shows such a second pay table.

TABLE 12

| POKER HAND | NUMBER OF COINS BET 1 | 2 | 3 | 4 | 5 |
|---|---|---|---|---|---|
| ROYAL FLUSH | 250 | 500 | 750 | 1000 | 4000 |
| STRAIGHT FLUSH | 80 | 160 | 240 | 320 | 400 |
| FOUR ACES | 200 | 400 | 600 | 800 | 1000 |
| FOUR KINGS, QUEENS OR JACKS | 150 | 300 | 450 | 600 | 750 |
| FOUR 2's, 3's OR 4's | 90 | 180 | 270 | 360 | 450 |
| FOUR 5's THRU 10'S | 60 | 120 | 180 | 240 | 300 |
| FULL HOUSE | 8 | 16 | 24 | 32 | 40 |
| FLUSH | 5 | 10 | 15 | 20 | 25 |
| STRAIGHT | 4 | 8 | 12 | 16 | 20 |
| THREE-OF-A-KIND | 3 | 6 | 9 | 12 | 15 |
| TWO PAIR | 1 | 2 | 3 | 4 | 5 |
| JACKS OR BETTER | 1 | 2 | 3 | 4 | 5 |

This pay table offers the player an expected return of approximately 99.42%.

Alternatively, other payout tables can be utilized depending on the expected return the house wishes to offer to the player.

This Version #1 may also be applied to multiple hand games such as those described in U.S. Pat. No. 5,823,873, the disclosure of which is incorporated herein by this reference. In this variation, the player would make multiple wagers to play two or more hands. If the player was dealt an initial hand of Three-of-a-Kind, the player would have the option of playing each of these multiple hands against the second pay table which would offer higher payouts in the player were to improve any or all of the hands into a final poker hand ranking of higher than Three-of-a-Kind.

Version #2.

Bonus Hand on Dealt Three-of-a-Kind

Another variation of the present invention involves offering the player an additional bonus hand to play whenever the player achieves a particular predetermined starting hand in the regular draw poker game. For example, if the player is dealt a Three-of-a-Kind on his first five card starting hand and the player holds the Three-of-a-Kind, the player is awarded with an additional bonus hand of the same Three-of-a-Kind that the player has on his first hand. The player then plays out his first hand (by holding the Three-of-a-Kind and drawing two replacement cards) to achieve a final five card hand on this first hand. The player also plays out his second bonus hand by holding the Three-of-a-Kind and drawing two replacement cards to achieve a final five card hand on this second hand. Awards to the player are based on a pay table for the poker hand ranking of the final first hand and the poker hand ranking of the final second hand.

In one of the preferred embodiments of this invention, the method of play uses a separate decks of cards for each of the initial hand and the bonus hand. For example, the initial hand is dealt using a first standard fifty-two card deck and the replacement cards for the initial come from the forty-seven remaining cards. Likewise, the replacement cards for the bonus hand are dealt from another deck of forty-seven cards which comprises a standard fifty-two card deck having the player's five initial cards omitted therefrom. This would allow the player, for example, to theoretically make two of the same Four-of-a-Kinds in each of the two separate hands.

Alternatively, a single deck of fifty-two playing cards can be used as the source of the replacement cards for both the initial hand and the bonus hand.

If the player is not dealt a Three-of-a-Kind on his initial five card first hand, the game continues in the conventional manner with just a single hand.

Any suitable pay table may be used for this version #2 and a representative pay table is shown in Table 13.

TABLE 13

| | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR ACES WITH A KICKER (2, 3 OR 4) | 400 | 800 | 1200 | 1600 | 2000 |
| FOUR 2'S, 3'S OR 4'S WITH A KICKER (ACE, 2, 3 OR 4) | 160 | 320 | 480 | 640 | 800 |
| FOUR ACES | 160 | 320 | 480 | 640 | 800 |
| FOUR 2's, 3's OR 4's | 80 | 160 | 240 | 320 | 400 |
| FOUR 5's THRU KINGS | 50 | 100 | 150 | 200 | 250 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5 |

The example shown in Table 13 is for a pay table that can be used with a Double Double Bonus Poker format for a video draw poker game. This pay table offers the player an expected return of approximately 95%. Alternatively, other payout tables can be utilized depending on the expected return the house wishes to offer to the player. The method of Version #2 of the present invention can be applied to any other suitable video poker formats such as Draw Poker, Bonus Poker, Double Bonus Poker, Triple Bonus Poker, Super Double Bonus Poker, Joker Poker, Deuces Wild Poker and the like.

Figure 3:
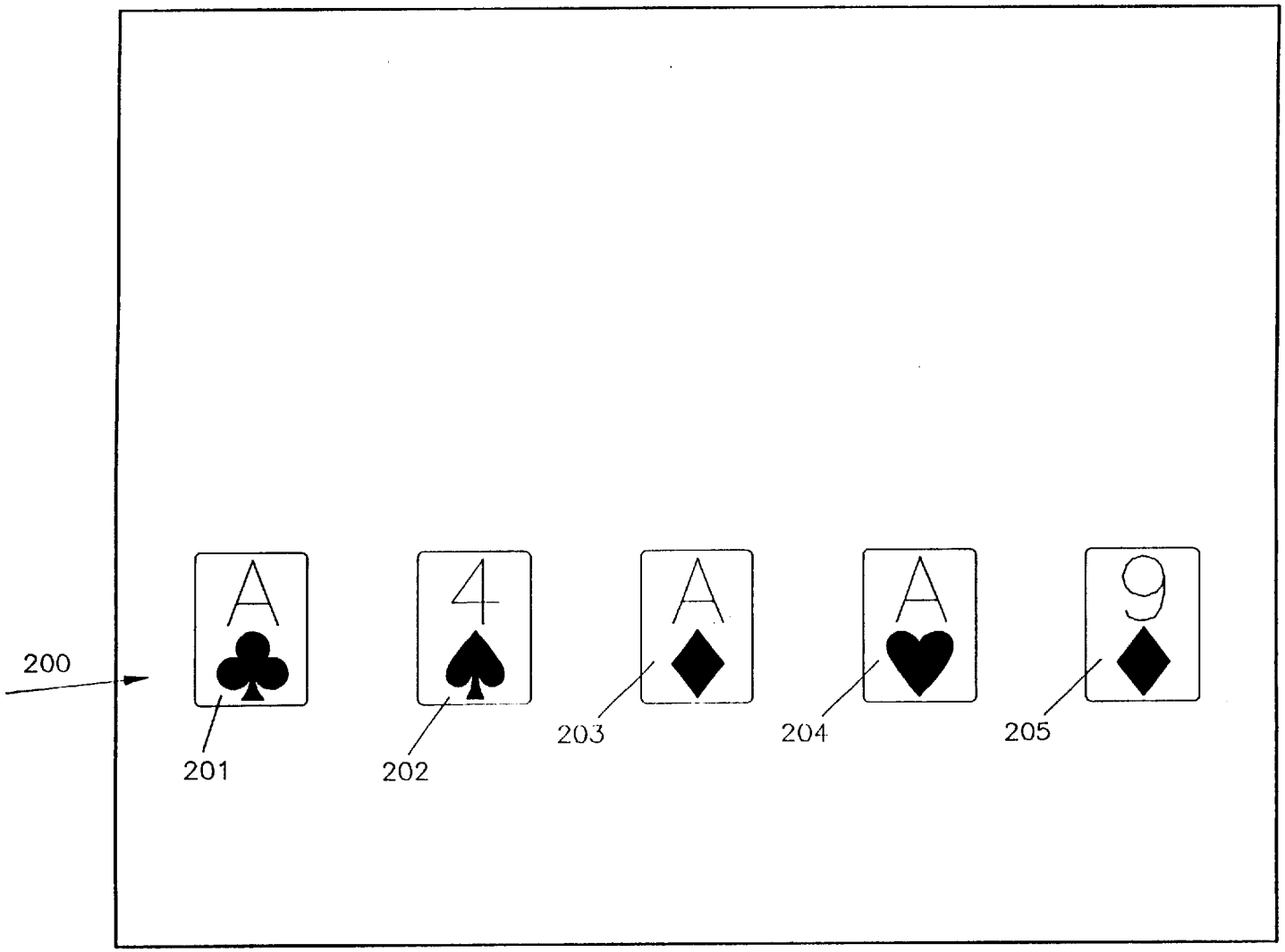
FIG. 3 shows the screen display for Version #2 of the present invention after the initial deal of the cards.
Figure 4:
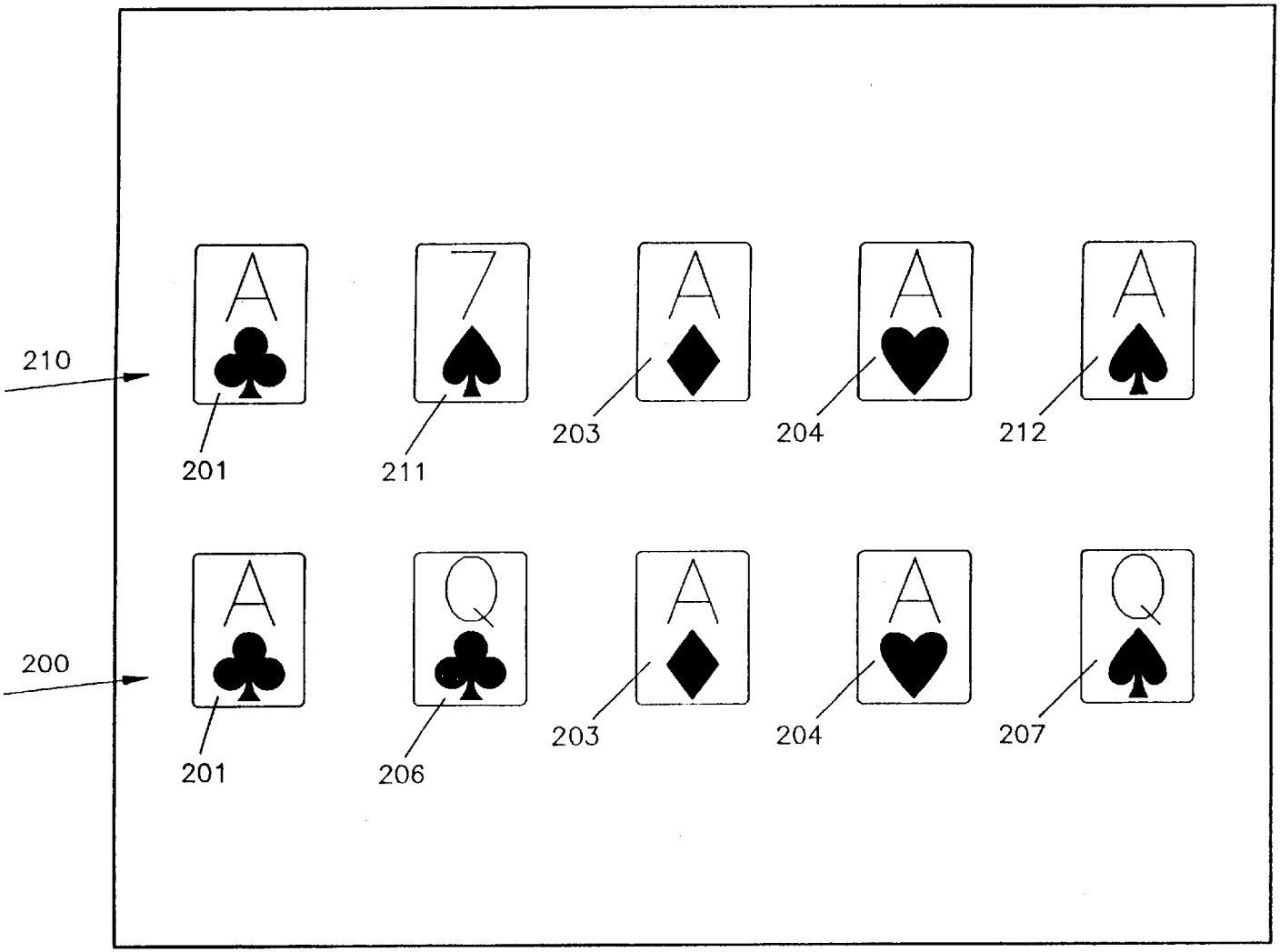
FIG. 4 shows the screen display for Version #2 after the draw step and shows a result that could occur during the play of the game.

An example of the method of play of this Version #2 is shown in FIGS. 3–4. A player makes a wager of five credits and is dealt as his first hand 200 the following five cards: the Ace of Clubs 201, the Four of Spades 202, the Ace of Diamonds 203, the Ace of Hearts 204 and the Nine of Diamonds 205. The player then chooses to hold the Three Aces. Because the player has been initially dealt a Three-of-a-Kind and because the player has held the Three-of-a-Kind, the player is then awarded a second bonus hand 210 of the same Three Aces.

As shown in FIG. 4, both the first hand 200 and the second hand 210 receive two additional cards to complete to final five card hands. In the first hand 200, the player's final five card hand has the Ace of Clubs 201, the Queen of Clubs 206, the Ace of Diamonds 203, the Ace of Hearts 204 and the Queen of Spades 207. This is a Full House and the player wins thirty-five credits based on his original wager of five credits as shown in Table 13.

In the second hand 210, the player's final five card hand has the Ace of Clubs 201, the Seven of Spades 211, the Ace of Diamonds 203, the Ace of Hearts 204 and the Ace of Spades 212. This is a Four-of-a-Kind (Aces) and the player wins eight hundred credits based on his original wager of five credits as shown in Table 13.

Other starting hands can be used as the triggering event in which the player would be awarded with additional free hands to play. For example, whenever the player has a starting hand of Two Pair, the player could be awarded with an additional hand of the same Two Pair. A suitable pay table would be provided for this embodiment in which Two Pair in the starting hand is the triggering event.

This version #2 can also be applied to multiple hand video poker games such as those described in U.S. Pat. No. 5,823,873, the disclosure of which is incorporated herein by this reference. As an example of this variation, the player makes three separate wagers, one for each of the hands the player is going to play. A initial hand of five cards is dealt to the player and the player selects which, if any, of the initial five cards are to be held. The held cards, if any, are then used in each of the three hands being played by the player. Each hand is then completed to have a final five card hand. Winning and losing hands are determined based on the poker hand ranking of each hand against a pay table.

In this Version #2, whenever the player is dealt a Three-of-a-Kind on the initial five cards and the player holds the Three-of-a-Kind, the player is provided with a fourth hand of the same Three-of-a-Kind. Just as each of the first three hands are completed to a final five card hand by dealing additional cards, so is the fourth hand completed to a final five card hand by dealing additional cards. Winning and losing hands are determined based on the poker hand ranking of each hand against a pay table.

Thus, the player is given a free fourth hand whenever the player is dealt a Three-of-a-Kind and holds the Three-of-a-Kind on his initial three hands. A representative pay table for this embodiment is shown in Table 14.

TABLE 14

| | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR ACES WITH A KICKER (2, 3 OR 4) | 400 | 800 | 1200 | 1600 | 2000 |
| FOUR 2'S, 3'S OR 4'S WITH A KICKER (ACE, 2, 3 OR 4) | 160 | 320 | 480 | 640 | 800 |
| FOUR ACES | 160 | 320 | 480 | 640 | 800 |
| FOUR 2's, 3's OR 4's | 80 | 160 | 240 | 320 | 400 |
| FOUR 5's THRU KINGS | 50 | 100 | 150 | 200 | 250 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 3 | 6 | 9 | 12 | 15 |
| TWO PAIR | 1 | 2 | 3 | 4 | 5 |
| JACKS OR BETTER | 1 | 2 | 3 | 4 | 5 |

The example shown in Table 14 is for a pay table that can be used with a Double Double Bonus Poker format for a video draw poker game. This pay table offers the player an expected return of approximately 95%. Alternatively, other payout tables can be utilized depending on the expected return the house wishes to offer to the player. The multiple hand variation of the method of Version #2 of the present invention can be applied to any other suitable video poker formats such as Draw Poker, Bonus Poker, Double Bonus Poker, Triple Bonus Poker, Super Double Bonus Poker, Joker Poker, Deuces Wild Poker and the like.

Version #3.

Pair of Aces+Bonus Game on Player's Starting Hand

This version #3 involves a secondary event bonus game in which the player is awarded a separate bonus game to play whenever the player achieves a pre-established starting hand in the regular video poker game. Any suitable starting hand can be used as the triggering event to take the player to a secondary event bonus round of play.

In the preferred embodiment of this Version #3 of the present invention, whenever the player achieves a Straight or Better as his starting hand in a game of video poker, the player wins the secondary event bonus round. A suitable bonus round can involve one or more hands of stud poker.

Figure 5:
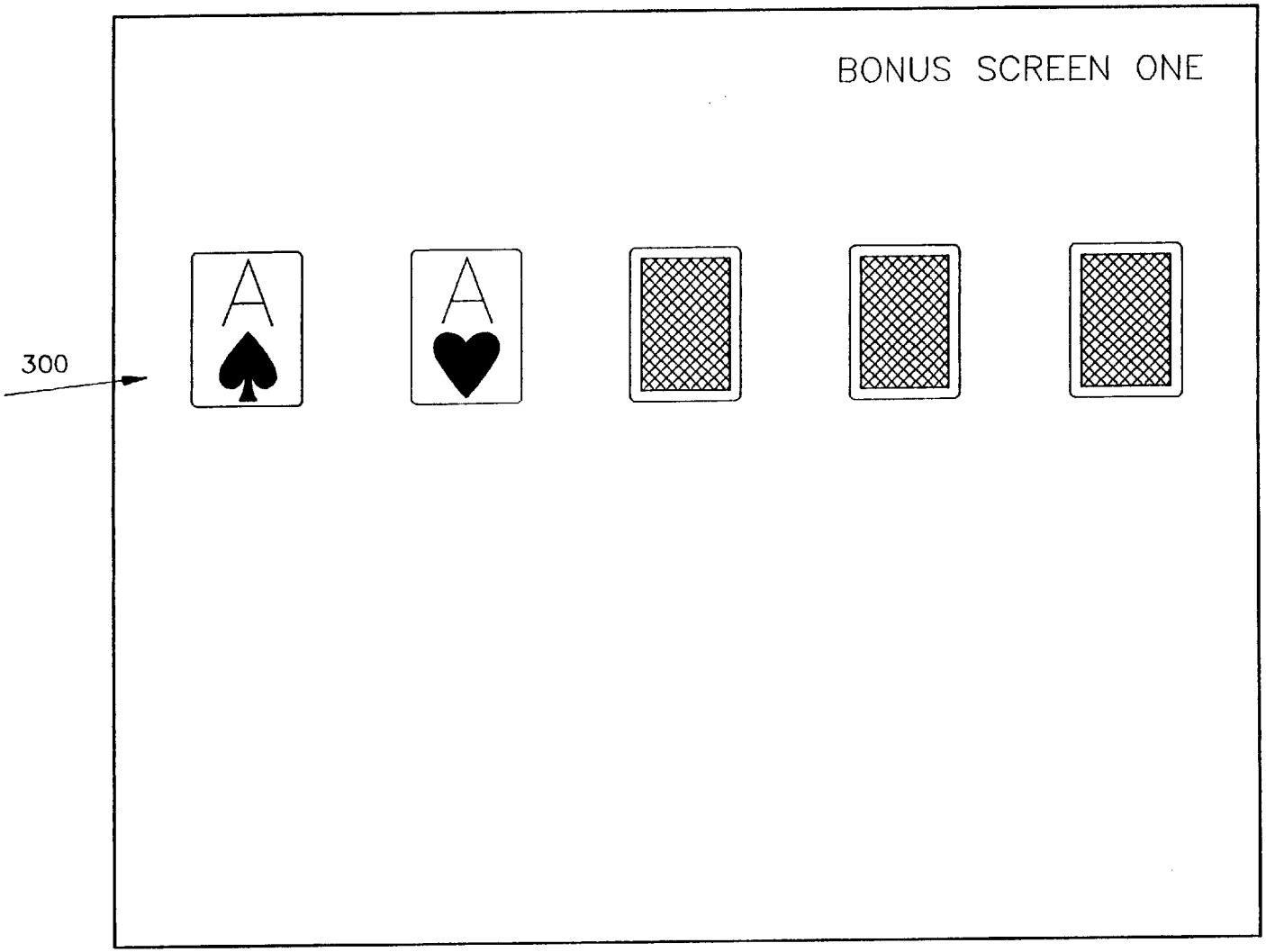
FIG. 5 shows the screen display for Version #3 of the present invention showing the first bonus screen.
Figure 6:
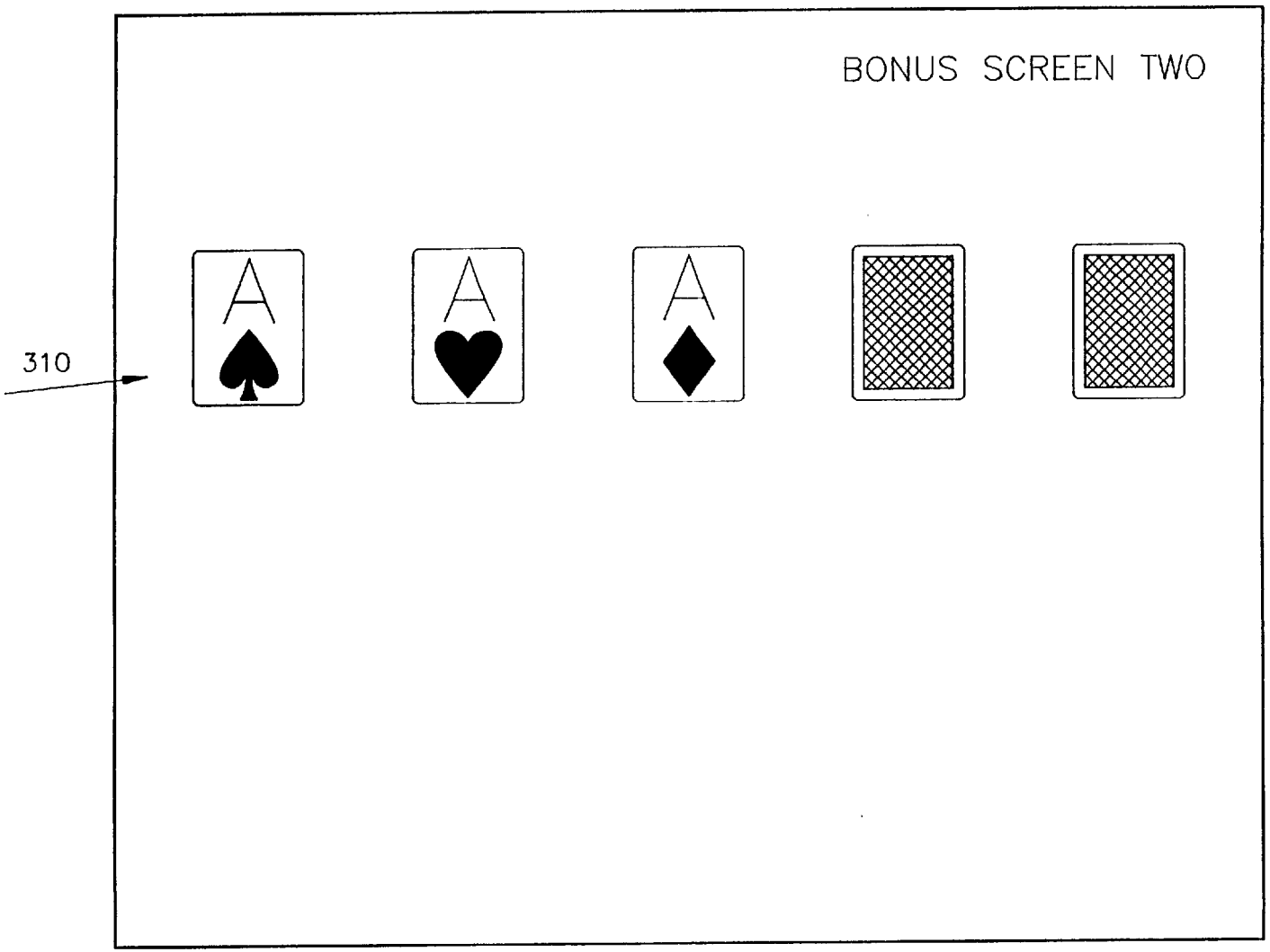
FIG. 6 shows the screen display for Version #3 of the present invention showing the second bonus screen.
Figure 7:
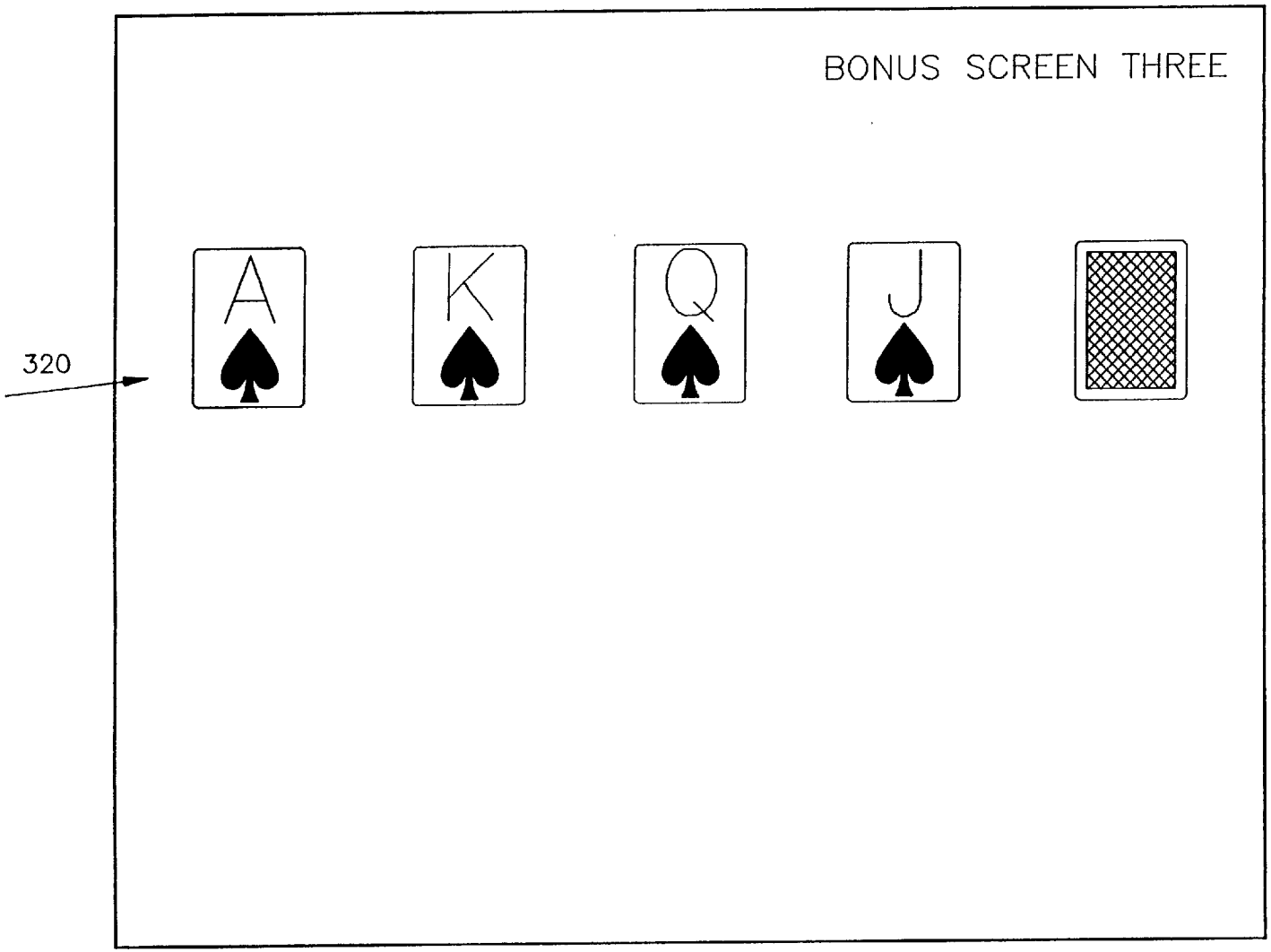
FIG. 7 shows the screen display for Version #3 of the present invention showing the third bonus screen.

An example of a preferred bonus round for this version #3 can be shown using the bonus screen displays shown in FIGS. 5–7. When the player has achieved a Straight or Better as his starting hand in the regular video poker game, the player is awarded with the bonus round. The first bonus screen is shown in FIG. 5 and the player is presented with a starting hand 300 of Two Aces and three other cards. The other three cards are revealed and the player is paid a first bonus for the poker hand ranking of the first bonus hand 300 based on a suitable pay table and based on the number of coins, tokens or credits that the player had wagered in the regular game. Since the first bonus hand has at least Two Aces, the player will win the payout for a Pair of Jacks or Better even if the other three cards when revealed do not improve the player's first bonus hand.

If the player achieves a Three-of-a-Kind in Aces in the first bonus hand 300, the player is awarded with the second bonus screen as shown in FIG. 6. In the second bonus screen, the player is presented with a starting hand 310 of Three Aces and two other cards. The other two cards are revealed and the player is paid a second bonus for the poker hand ranking of the second bonus hand 310 based on a suitable pay table and based on the amount wagered by the player in the regular game. Since the second bonus hand has at least Three Aces, the player will win the payout for a Three-of-a-Kind even if the other two cards when revealed do not improve the player's second bonus hand.

If the player achieves a Four-of-a-Kind in Aces in the second bonus hand 310, the player is awarded with the third bonus screen as shown in FIG. 7. In the third bonus screen, the player is presented with a starting hand 320 of Four to a Royal Flush (such as the Ace, King, Queen and Jack of Spades) and one other card. The one other card is revealed and the player is paid a third bonus for the poker hand ranking of the third bonus hand 320 based on a suitable pay table and based on the amount wagered by the player in the regular game. If the one other card when revealed is the Ten of Spades, the player would win a large payout for having achieved the Royal Flush. This large payout would be in addition to whatever payouts the player had won in the regular game and on the first bonus hand and the second bonus hand.

These three bonus screens are merely representative of the types of bonus rounds that can be made available to the player whose final hand comprises a pre-selected ending hand arrangement of cards. As an alternative to the three bonus hands described above, the player could receive a single bonus hand as his bonus round, the player could receive two cumulative bonus hands as his bonus round or the player could receive four or more cumulative bonus hands as his bonus round. The player could also receive as his bonus round a free multiple hand play, such as a free round of a Triple Play game.

Another variation of this Version #3 involves having the player receive multiple hand bonus screens. Instead of only receiving a single bonus hand to play in each of the bonus screens as shown in FIGS. 5–7, the player could be awarded two or multiple hands on each bonus screen.

Figure 8:
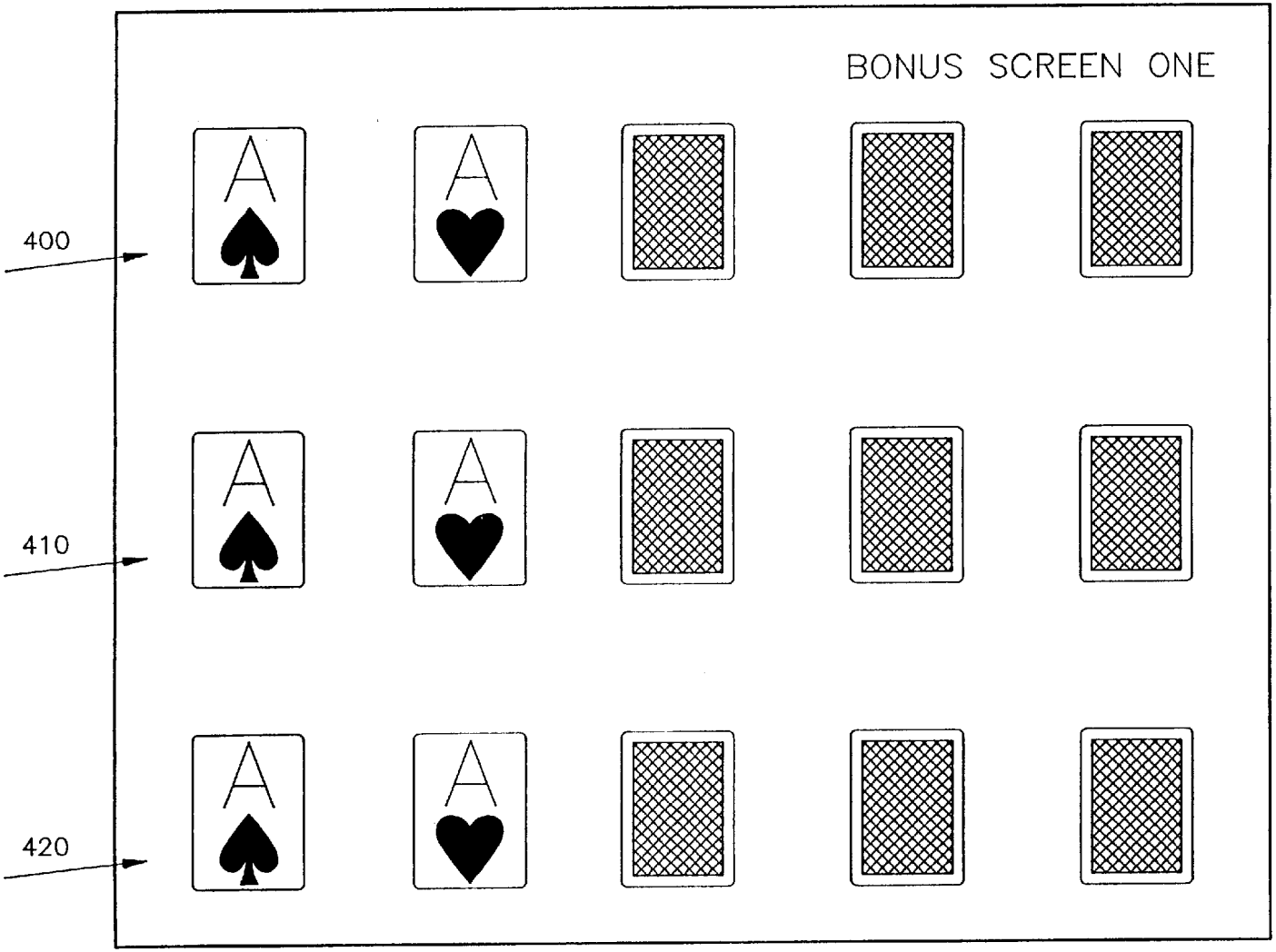
FIG. 8 shows the screen display for an alternate embodiment of Version #3 of the present invention showing the first bonus screen.
Figure 9:
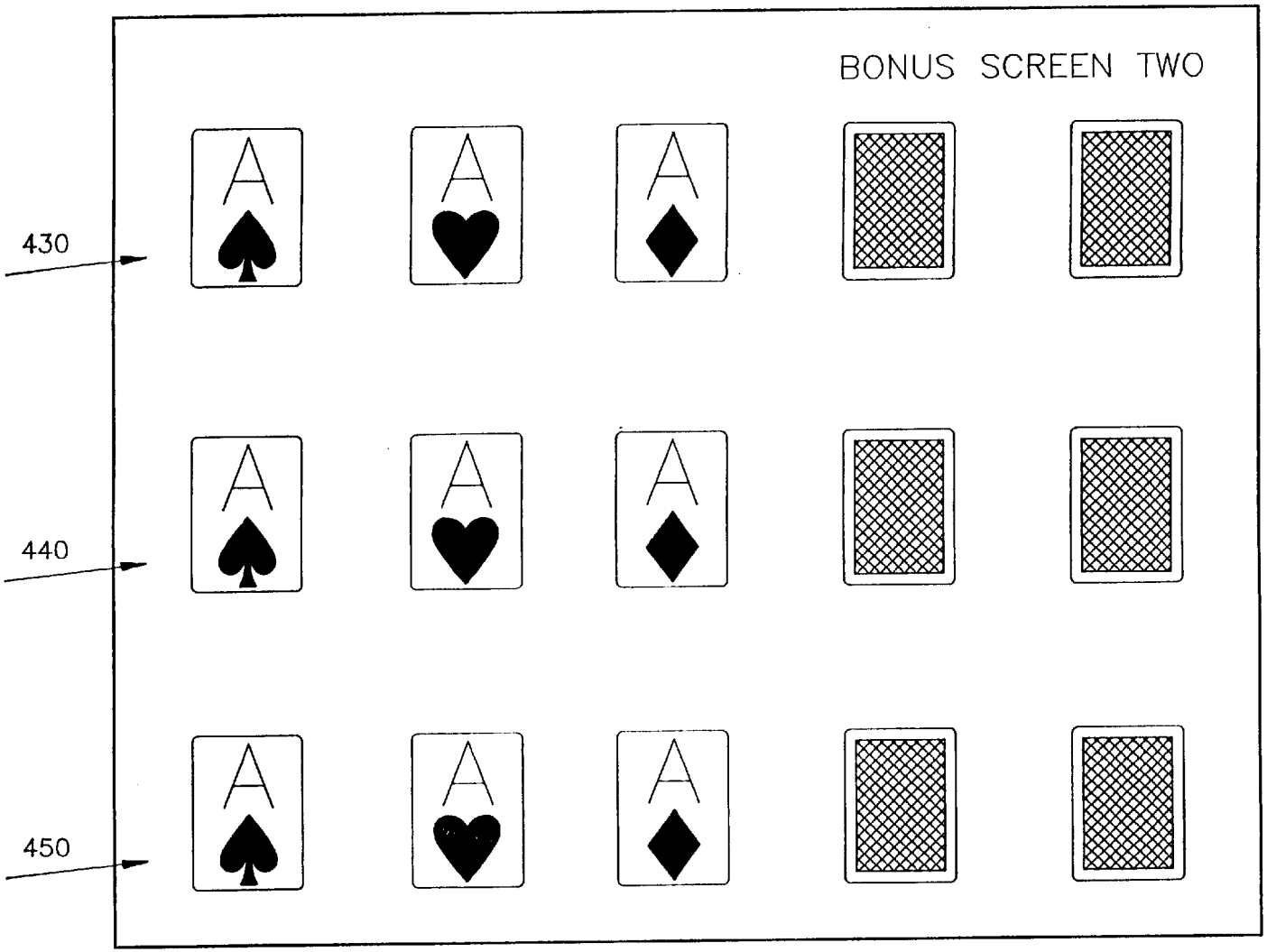
FIG. 9 shows the screen display for Version #3 of the present invention showing the second bonus screen.
Figure 10:
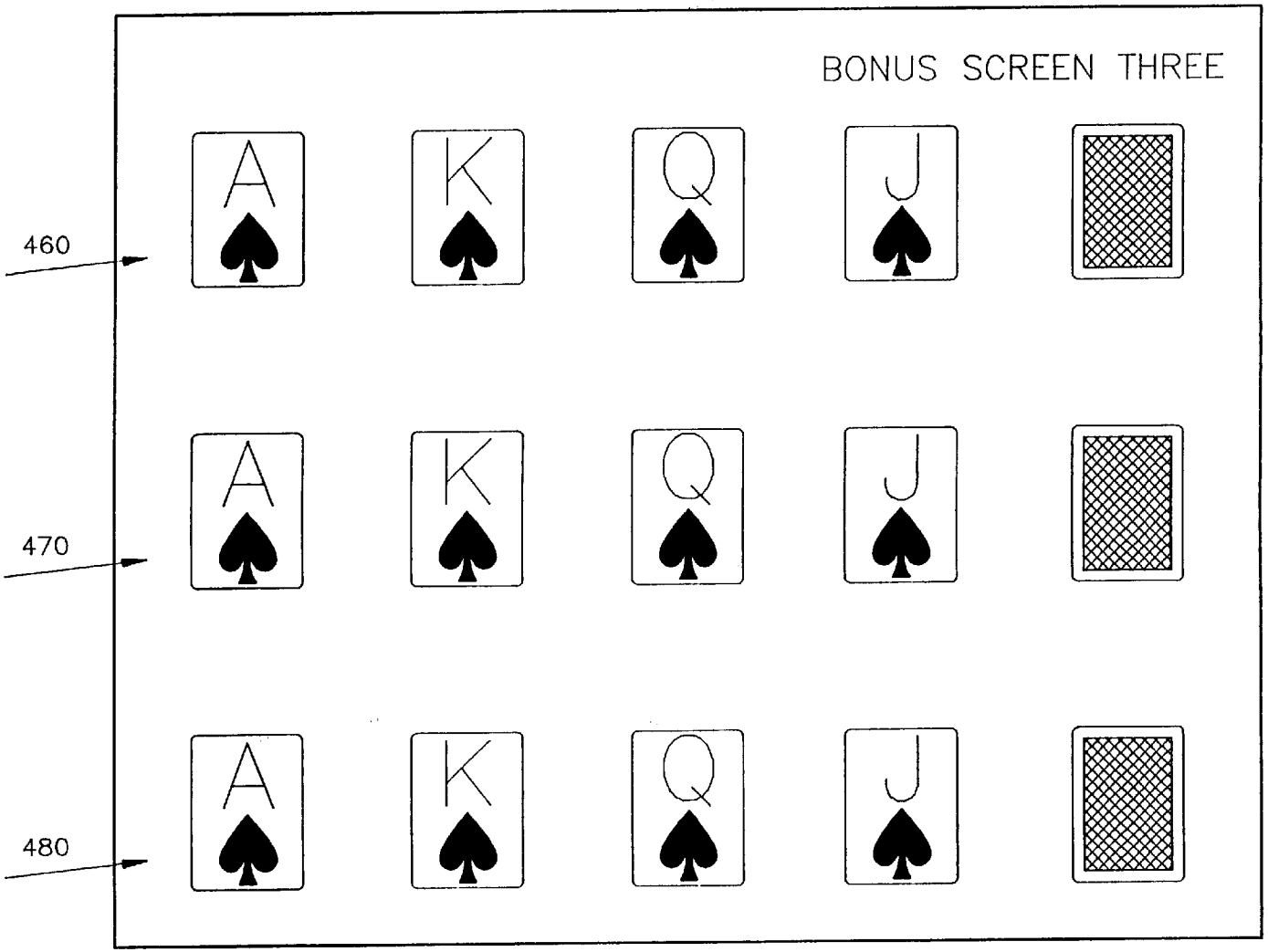
FIG. 10 shows the screen display for Version #3 of the present invention showing the third bonus screen.

An example of this variation can also be shown using FIGS. 8–10. When the player has achieved a Straight or Better as his starting hand in the regular video poker game, the player is awarded with the first bonus screen as shown in FIG. 8 and the player is presented with three starting hands 400, 410 and 420 of Two Aces and three other face down cards, each starting hand being dealt from a separate deck of playing cards. The three face down cards in each hand are revealed and the player is paid a first bonus for the poker hand ranking of each of the first bonus hands 400, 410 and 420 based on a suitable pay table and based on the number of coins, tokens or credits that the player had wagered in the regular game. Since each of the first bonus hands have at least Two Aces, the player will win the payout for a Pair of Jacks or Better even if the other three cards when revealed do not improve any of the player's first bonus hands.

If the player achieves a Three-of-a-Kind in Aces in any of the first bonus hands 400, 410 or 420 the player is awarded with the second bonus screen as shown in FIG. 9. In the second bonus screen, the player is presented with three starting hands 430, 440 and 450 of Three Aces and two other face down cards, each hand being dealt from a separate deck. The two face down cards are revealed and the player is paid a second bonus for the poker hand ranking of each of the second bonus hands 430, 440 and 450 based on a suitable pay table and based on the amount wagered by the player in the regular game. Since each of the second bonus hands have at least Three Aces, the player will win the payout for a Three-of-a-Kind even if the other two cards when revealed do not improve any of the player's second bonus hands.

If the player achieves a Four-of-a-Kind in Aces in any one of the second bonus hands 430, 440 or 450, the player is awarded with the third bonus screen as shown in FIG. 10. In the third bonus screen, the player is presented with three starting hands 460, 470 and 480 of Four to a Royal Flush (such as the Ace, King, Queen and Jack of Spades) and one other face down card, each hand being dealt from a separate deck. The one other face down card is revealed and the player is paid a third bonus for the poker hand ranking of each of the third bonus hands 460, 470 and 480 based on a suitable pay table and based on the amount wagered by the player in the regular game. If the one other card when revealed is the Ten of Spades, the player would win a large payout for having achieved the Royal Flush. In fact, the player can be awarded special payouts for achieving two Royal Flushes or three Royal Flushes. Depending on how the bonus payouts are structured, it is possible to award the player one million credits for achieving three Royal Flushes on this third bonus screen. These large payouts would be in addition to whatever payouts the player had won in the regular game and on the first bonus hand and the second bonus hand.

Version #4A.

Exchange Starting Hand for One or More Different Starting Hands

This version #4A of the present invention involves offering the player the option of exchanging his starting hand for one or more different partial starting hands. The offer is made whenever the player achieves a pre-established starting hand in the regular video poker game. Any suitable starting hand can be used as the triggering event to trigger the offer to the player to exchange the starting hand for a different starting hand.

In the preferred embodiment of this Version #4A of the present invention, whenever the player achieves a Pair of Jacks, a Pair of Queens or a Pair of Kings as his starting hand in a game of video poker, the player is offered to exchange his starting hand for one or more partial starting hands of Three to a Royal Flush; this is known as the Chase the Royal game.

Figure 11:
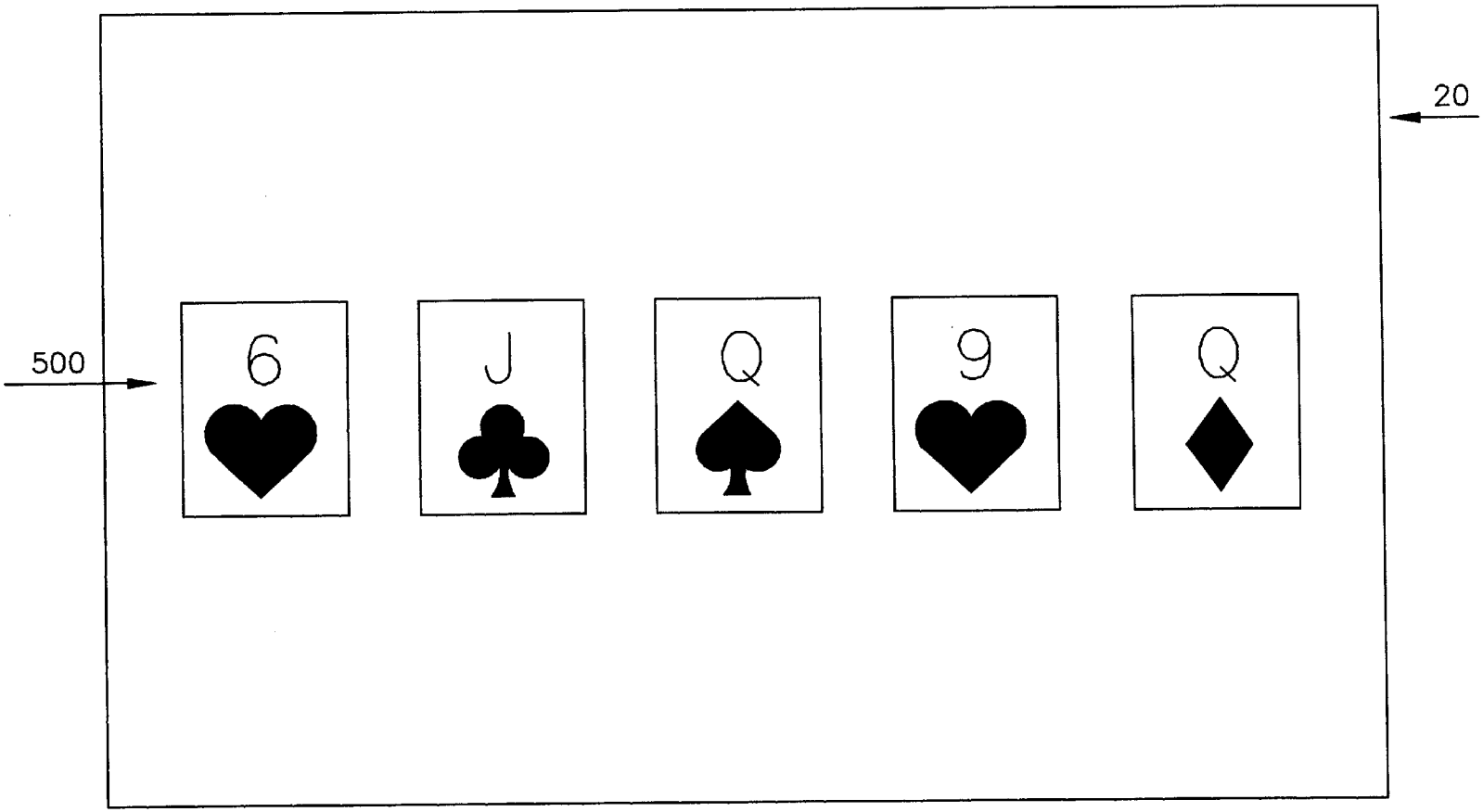
FIG. 11 shows the screen display for Version #4A of the present invention after the deal of the starting hand.
Figure 12:
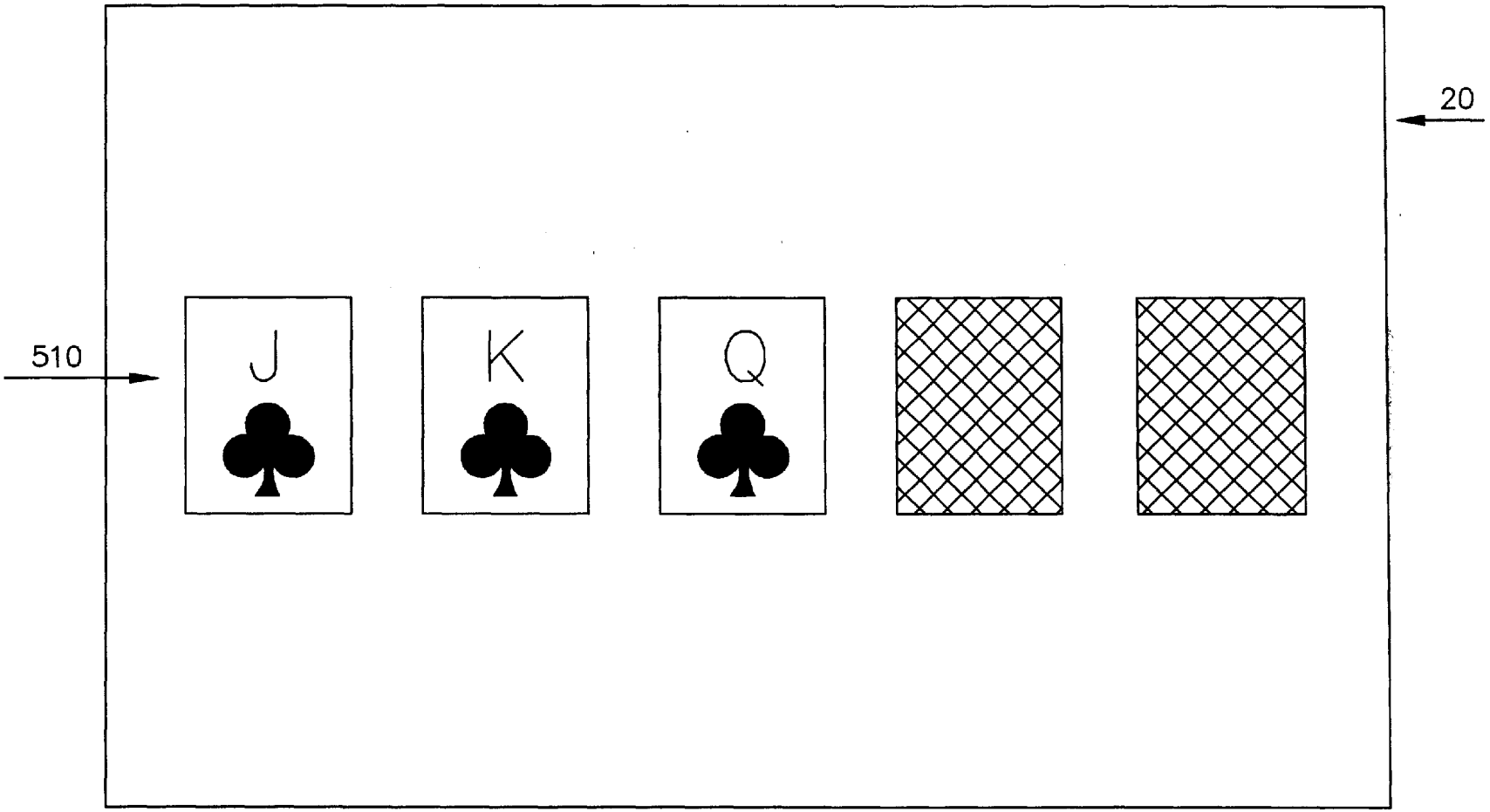
FIG. 12 shows the screen display for Version #4A of the present invention after the player has accepted the offer to exchange his starting hand.
Figure 13:
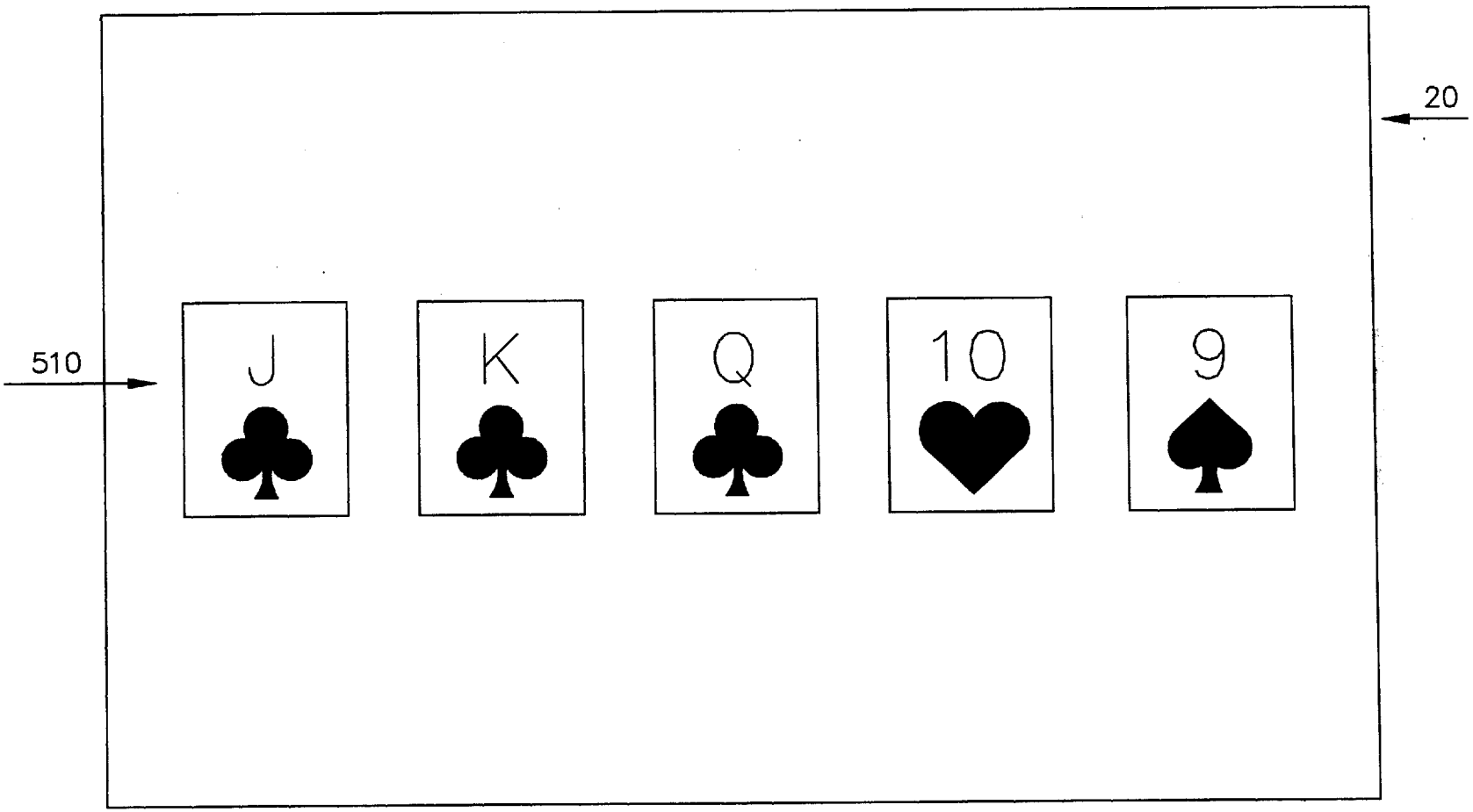
FIG. 13 shows the screen display for Version #4A of the present invention after the final hand has been completed.

An example of this version #4A is shown using the screen displays in FIGS. 11–13. The player makes his initial wager and is dealt a starting hand 500 of five cards. As shown in FIG. 11, the player has been dealt the Six of Hearts, the Jacks of Clubs, the Queen of Spades, the Nine of Hearts and the Queen of Diamonds. Because the player has achieved a Pair of Queens on the starting hand 500, the player is offered the opportunity to exchange his entire starting hand for one or more partial starting hands of Three to a Royal Flush. In the preferred embodiment of the present invention, the player having started with one hand is offered to exchange that one hand for one hand of Three to a Royal Flush and no additional wager is required from the player to make this exchange. The amount wagered by the player on the initial starting hand is applied to new hand of Three to a Royal Flush received if the player accepts the exchange. For example, if the player had wagered five credits on the first hand, then the new hand of Three to a Royal Flush would also carry the five credit wager associated therewith.

As shown in FIG. 12, the player has accepted this offer and one partial hand of Three to a Royal Flush is displayed to the player. For example, the player could receive a new hand 510 of the Jack of Clubs, the King of Clubs and the Queen of Clubs.

Any suitable manner can be used to select which of the three cards that will form the Three to a Royal Flush can be used. For example, the computer controls of the gaming machine can be programmed to always display the same three honor cards of one of the suits. Preferably, the computer controls would randomly shuffle the five honor cards (the five honor cards of any suit are the Ace, King, Queen, Jack and Ten of that suit) and randomly select three of the honor cards to be displayed as the Three to a Royal Flush. From the standpoint of mathematical probability, which suit is used is irrelevant, but to add variety for the player, the particular suit can also be randomly selected.

After the new hand of Three to a Royal Flush has been displayed, the remaining two cards for the new hand are dealt and displayed to the player. For example, as shown in FIG. 13, the player has received a Ten of Hearts and a Nine of Spades to complete the final hand 510. The poker hand ranking of this hand is a Straight.

Any suitable pay table can be used for the Three to a Royal Flush hand or hands. The usual winning hands that would be provided for in the pay table would be a Royal Flush, Straight Flush, Flush, Straight, Three-of-a-Kind, Two Pair and a pair of Jacks or Better.

This same Three-to-a-Royal exchange hand feature can be used with multiple hand poker games, such as those disclosed in U.S. Pat. No. 5,823,873. Whatever number of starting the hands the player initially wagers on to play, the same number of new hands of Three-to-a-Royal Flush would be offered to the player who achieves a predetermined starting hand, such a Pair of Jacks, a Pair of Queens or a Pair of Kings. For example, if the player is playing TRIPLE PLAY DRAW POKER™, and the player is dealt a starting hand that includes a Pair of Jacks, a Pair of Queens or a Pair of Kings, the player would be offered the opportunity to exchange his TRIPLE PLAY DRAW POKER™ starting hand for three new partial hands of Three-to-a-Royal Flush. All three new hands could have the same Three-to-a-Royal Flush cards or they each could have different Three-to-a-Royal Flush cards.

The two additional cards for all three hands (six cards in all) can be dealt from the remaining deck of forty-nine cards. Or the two additional cards for each of the three hands can be dealt from three separate decks each having the remaining forty-nine cards. There is no mathematical difference in whichever way is chosen.

If the player should decline the exchange offer, the method of play continues in accordance with the conventional manner of play of the game.

In a variation of this Version #4A, rather than offering the player the opportunity to exchange his starting hand for one or more new partial hands, the exchange could simply be mandatory. Whenever the player received on the initial deal a hand that qualifies for an exchange, the computer controls of the gaming machine effect the exchange and the game simply continues in the same manner as described above in conjunction with the method of play in which the player elects to accept the exchange offer.

Version #4B.

Exchange Starting Hand for Two or More Different Starting Hands

This version #4B of the present invention involves offering the player the option of exchanging his starting hand for two or more different partial starting hands. The offer is made whenever the player achieves a pre-established starting hand in the regular video poker game. Any suitable starting hand can be used as the triggering event to trigger the offer to the player to exchange the starting hand for two or more different starting hand.

In the preferred embodiment of this Version #4B of the present invention, whenever the player achieves a Pair of Aces as his starting hand in a game of video poker, the player is offered to exchange his starting hand for two or more partial starting hands of Two Aces.

Figure 14:
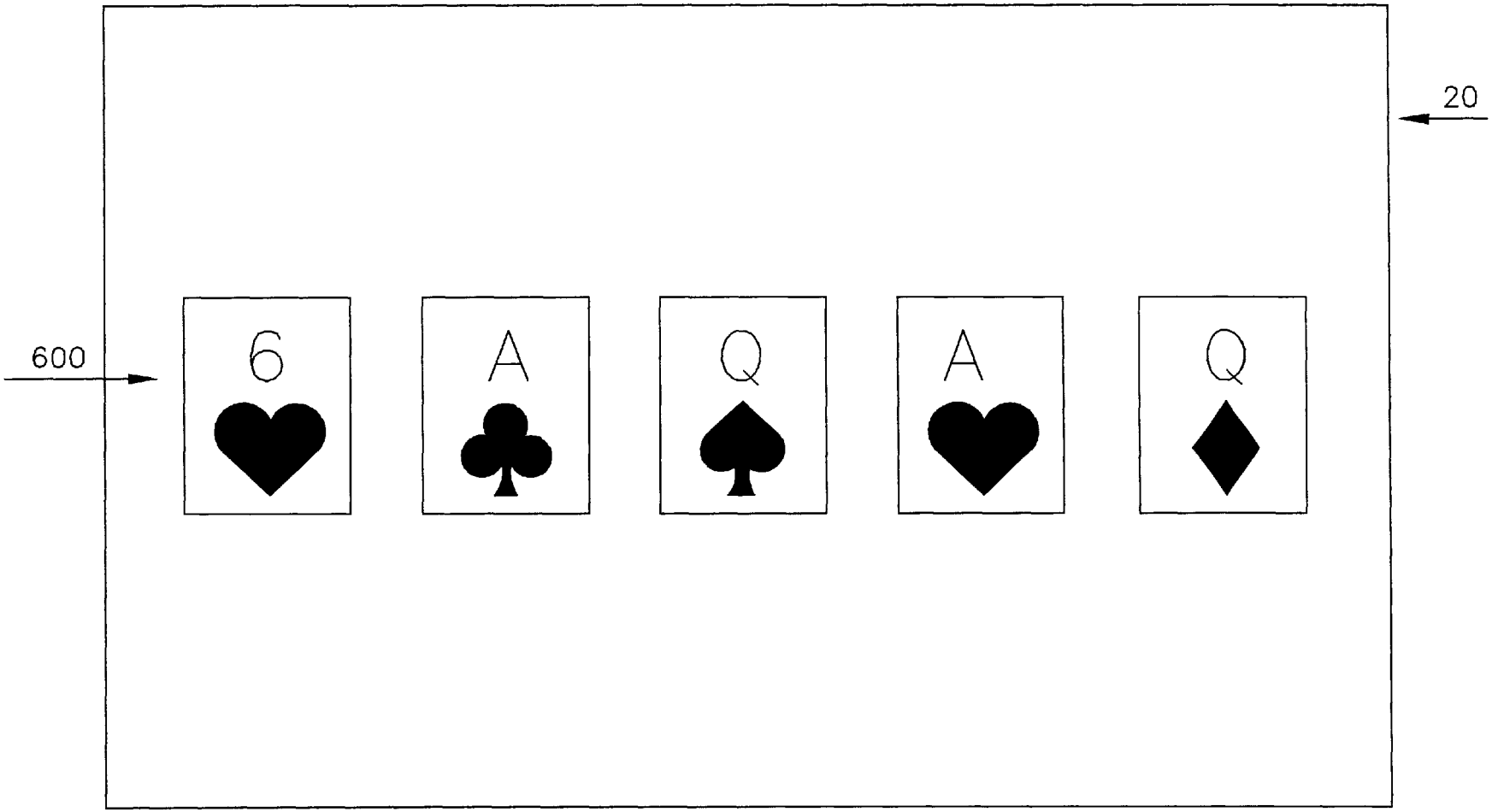
FIG. 14 shows the screen display for Version #4B of the present invention after the deal of the starting hand.
Figure 15:
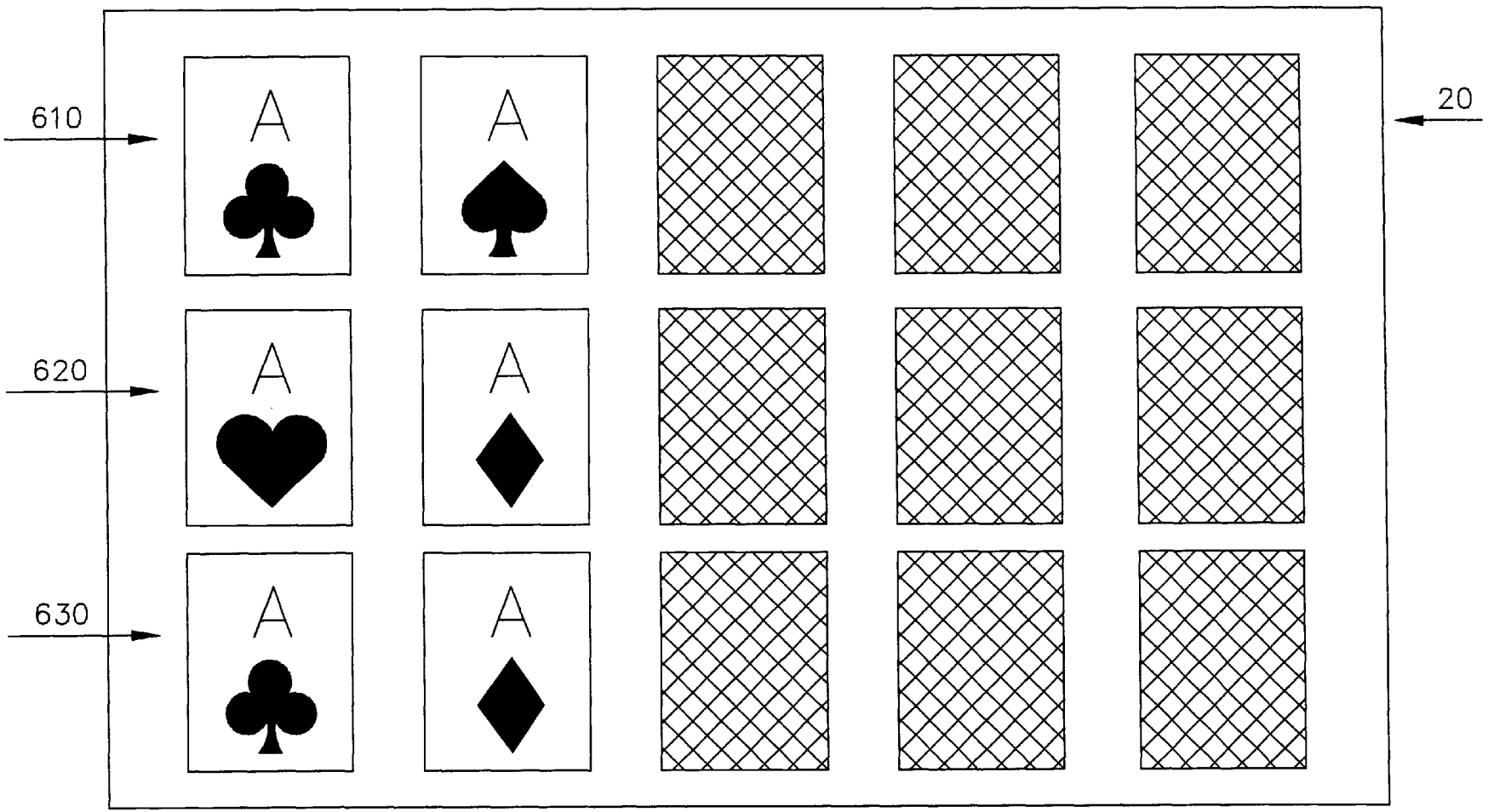
FIG. 15 shows the screen display for Version #4B of the present invention after the player has accepted the offer to exchange his starting hand for two more hands.
Figure 16:
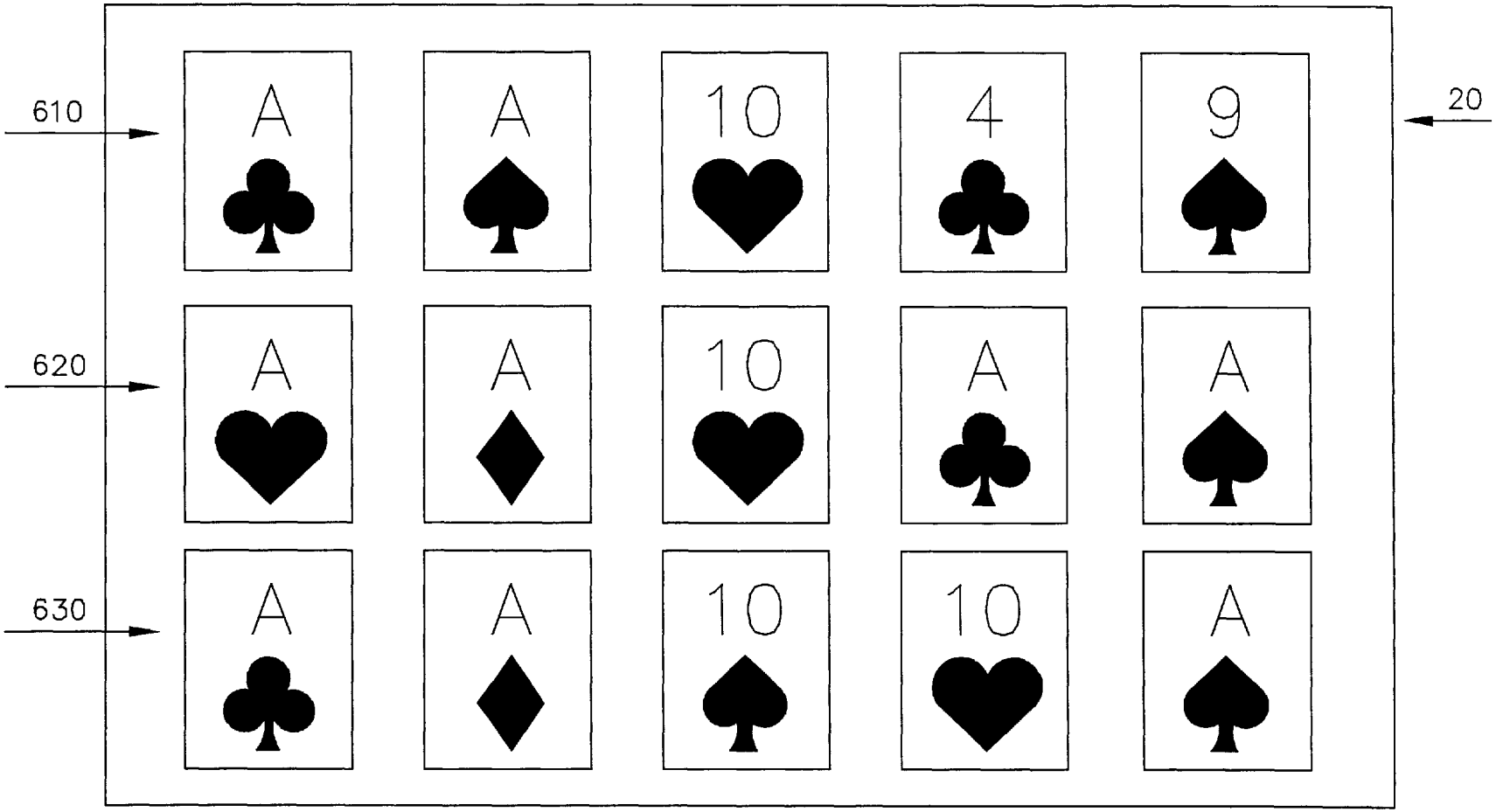
FIG. 16 shows the screen display for Version #4B of the present invention after the final hands have been completed.

An example of this version #4B is shown using the screen displays in FIGS. 14–16. The player makes his initial wager and is dealt a starting hand 600 of five cards. As shown in FIG. 14, the player has been dealt the Six of Hearts, the Ace of Clubs, the Queen of Spades, the Ace of Hearts and the Queen of Diamonds. Because the player has achieved a Pair of Aces on the starting hand 600, the player is offered the opportunity to exchange his entire starting hand for two or more partial starting hands of a Pair of Aces. In the preferred embodiment of the present invention, the player having started with one hand is offered to exchange that one hand for three hands of a Pair of Aces and no additional wager is required from the player to make this exchange. The amount wagered by the player on the initial starting hand is applied to each new hand of a Pair of Aces received if the player accepts the exchange. For example, if the player had wagered five credits on the first hand, then the three new hands of a Pair of Aces would each also carry the five credit wager associated therewith, although no extra coins, tokens or credits are actually required to be wagered by the player.

As shown in FIG. 15, the player has accepted this offer and three partial hands of a Pair of Aces is displayed to the player. For example, the player could receive a first new hand 610 of the Ace of Clubs and the Ace of Spades, a second new hand 620 of the Ace of Hearts and the Ace of Diamonds and a third new hand 630 of the Ace of Clubs and the Ace of Hearts.

Any suitable manner can be used to select which of the two cards that will form the Pair of Aces can be used. For example, the computer controls of the gaming machine can be programmed to always display the same two Aces of two of the suits. Preferably, the computer controls would randomly shuffle the four Ace cards and randomly select two of the Aces to be displayed as the Pair of Aces. From the standpoint of mathematical probability, which Aces from which two suits are used is irrelevant, but to add variety for the player, the particular two Aces can be randomly selected.

After the new hands of a Pair of Aces have been displayed, the remaining three cards for each new hand are dealt and displayed to the player. For example, as shown in FIG. 16, the player has received a Ten of Hearts, a Four of Clubs and a Nine of Spades to complete the first final hand 610. The poker hand ranking of this hand did not improve and is a Pair of Aces.

In hand 620, the player has received a Ten of Hearts, an Ace of Clubs and an Ace of Spades to complete the second final hand 620. The poker hand ranking of this hand improved to a Four-of-a-Kind Aces. In hand 630, the player has received a Ten of Spades, a Ten of Hearts and an Ace of Spades to complete the third final hand 630. The poker hand ranking of this hand improved to a Full House.

Any suitable pay table can be used for the Pair of Aces new partial starting hands. The usual winning hands that would be provided for in the pay table would be Four Aces (with or without a Kicker [a deuce, three or four are the typical Kicker cards used in video poker]), a Full House, Three-of-a-Kind, Two Pair and just the Pair of Aces.

Depending on the type of pay table that is desired to be offered to the player, the pay table may require the player to improve a hand beyond a Pair of Aces in order to have a winning hand. In such a situation, the payouts can be higher than would be usual and still maintain a decent game return to the gaming establishment.

The three additional cards for each of the three hands can be dealt from three separate decks each having the remaining fifty cards. Alternatively if the same Two Aces are displayed to the player, the three additional cards for each of the three partial hands can be dealt from a single deck of fifty cards.

If the player should decline the exchange offer, the method of play continues in accordance with the conventional manner of play of the game.

In a variation of this Version #4B, rather than offering the player the opportunity to exchange his starting hand for one or more new partial hands, the exchange could simply be mandatory. Whenever the player received on the initial deal a hand that qualifies for an exchange, the computer controls of the gaming machine effect the exchange and the game simply continues in the same manner as described above in conjunction with the method of play in which the player elects to accept the exchange offer.

In the preferred embodiments of the various versions of the present invention, the method of play uses a standard fifty-two card deck. One or more cards may also be designated as wild cards or one or more Jokers may be added to the deck to accommodate various forms of Joker Poker.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of playing a video poker game on an electronic gaming machine comprising:

a) displaying an initial hand to a player;

b) if the initial hand comprises a pre-established arrangement of cards, offering the player the opportunity to exchange the initial hand for at least one new partial hand;

c) if the player declines the offer to exchange, then the player plays out the initial hand according to the conventional manner of play of the video poker game;

d) if the player accepts the offer to exchange, providing the player with at least one new partial hand;

e) displaying additional cards in each new partial hand to form a final hand;

e) determining the poker hand ranking of each of the final hands; and f) determining whether any of the final hands is a winning hand.

2. The method of claim 1 in which the pre-established arrangement of cards is a Pair of Jacks, a Pair of Queens or a Pair of Kings.

3. The method of claim 2 in which each new partial hand is Three-to-a-Royal Flush.

4. The method of claim 3 in which the player makes a wager to participate in the game and in which the player receives an award based on a pay table and based on the amount of the wager if any of the final hands is a winning hand.

5. The method of claim 4 in which each of the new hands is treated as if the amount of the wager had been applied to that hand.

6. The method of claim 1 in which the pre-established arrangement of cards is a Pair of Aces.

7. The method of claim 6 in which the player receives at least two partial hands and each partial hand is a Pair of Aces.

8. The method of claim 7 in which the player makes a wager to participate in the game and in which the player receives an award based on a pay table and based on the amount of the wager if any of the final hands is a winning hand.

9. The method of claim 8 in which each of the new hands is treated as if the amount of the wager had been applied to that hand.

10. A method of playing a video poker game on an electronic gaming machine comprising:

a) displaying an initial hand to a player;

b) if the initial hand comprises a pre-established arrangement of cards, exchanging the initial hand for at least one new partial hand;

c) displaying additional cards in each new partial hand to form a final hand;

d) determining the poker hand ranking of each of the final hands; and e) determining whether any of the final hands is a winning hand.

11. The method of claim 10 in which the pre-established arrangement of cards is a Pair of Jacks, a Pair of Queens or a Pair of Kings.

12. The method of claim 11 in which each new partial hand is Three-to-a-Royal Flush.

13. The method of claim 12 in which the player makes a wager to participate in the game and in which the player receives an award based on a pay table and based on the amount of the wager if any of the final hands is a winning hand.

14. The method of claim 13 in which each of the new hands is treated as if the amount of the wager had been applied to that hand.

15. The method of claim 10 in which the pre-established arrangement of cards is a Pair of Aces.

16. The method of claim 15 in which the player receives at least two partial hands and each partial hand is a Pair of Aces.

17. The method of claim 16 in which the player makes a wager to participate in the game and in which the player receives an award based on a pay table and based on the amount of the wager if any of the final hands is a winning hand.

18. The method of claim 17 in which each of the new hands is treated as if the amount of the wager had been applied to that hand.

* * * * *